US010966525B2

(12) United States Patent
Bader

(10) Patent No.: US 10,966,525 B2
(45) Date of Patent: Apr. 6, 2021

(54) SEMI-FULL ACCESS AND FULL ACCESS FRAMED CABINETRY

(71) Applicant: Bader Intellectual Design, LLC, Broomfield, CO (US)

(72) Inventor: Cayd Paul Bader, Broomfield, CO (US)

(73) Assignee: TruFrame Cabinetry, LLC, Broomfield, CO (US)

( * ) Notice: Subject to any disclaimer, the term of this patent is extended or adjusted under 35 U.S.C. 154(b) by 119 days.

(21) Appl. No.: 15/464,151

(22) Filed: Mar. 20, 2017

(65) Prior Publication Data

US 2018/0000243 A1 Jan. 4, 2018

Related U.S. Application Data

(63) Continuation of application No. 13/905,461, filed on May 30, 2013, now Pat. No. 9,596,933, which is a continuation-in-part of application No. 13/486,730, filed on Jun. 1, 2012, now abandoned.

(60) Provisional application No. 61/492,049, filed on Jun. 1, 2011, provisional application No. 61/599,739, filed on Feb. 16, 2012.

(51) Int. Cl.

| | |
|---|---|
| ***A47B 96/00*** | (2006.01) |
| ***A47B 47/05*** | (2006.01) |
| ***A47B 47/04*** | (2006.01) |

(52) U.S. Cl.

CPC ..... *A47B 96/00* (2013.01); *A47B 47/04* (2013.01); *A47B 47/042* (2013.01); *A47B 47/05* (2013.01)

(58) Field of Classification Search

CPC ..... A47B 47/03; A47B 43/02; A47B 47/00; A47B 47/042; A47B 47/05; A47B 17/006; A47B 47/04; A47B 2230/0077

USPC ..... 312/263, 245, 198, 265.5, 257.1

See application file for complete search history.

(56) References Cited

U.S. PATENT DOCUMENTS

| | | | | |
|---|---|---|---|---|
| 419,920 A | | 1/1890 | Campbell | |
| 1,481,560 A | | 1/1924 | Ringer | |
| 2,284,480 A | * | 5/1942 | Schuh | F16B 12/04 312/257.1 |
| 2,360,451 A | | 10/1944 | Stone | |
| 2,437,665 A | | 3/1948 | Rose | |

(Continued)

FOREIGN PATENT DOCUMENTS

| | | |
|---|---|---|
| CN | 200947936 | 9/2007 |
| FR | 2062731 | 6/1971 |

(Continued)

OTHER PUBLICATIONS

International Search Report and Written Opinion for International (PCT) Patent Application No. PCT/US2012/040514, dated Aug. 7, 2012 12 pages.

(Continued)

*Primary Examiner* — Hiwot E Tefera

(74) *Attorney, Agent, or Firm* — Sheridan Ross P.C.

(57) ABSTRACT

A semi-full access and full access face frame for a cabinet box is provided, together with a method for making and assembling cabinet boxes. In a semi-full access face frame, the vertical stiles are rotated ninety degrees compared to a traditional face frame. In a full access face frame the vertical stiles and the horizontal rails are rotated ninety degrees compared to a traditional face frame.

12 Claims, 19 Drawing Sheets

(56) References Cited

U.S. PATENT DOCUMENTS

| | | | | | |
|---|---|---|---|---|---|
| 2,522,561 | A * | 9/1950 | Blechman | A47B 43/02 312/259 |
| 2,579,897 | A * | 12/1951 | Blechman | A47B 43/02 217/65 |
| 2,722,468 | A | 11/1955 | Perrin | |
| 2,741,524 | A | 4/1956 | Lew | |
| 2,752,215 | A | 6/1956 | Peiss | |
| 2,936,206 | A | 5/1960 | Wilmer et al. | |
| 3,021,187 | A | 2/1962 | Mitchell | |
| 3,124,402 | A | 3/1964 | Rhoads | |
| 3,150,903 | A * | 9/1964 | Chapman | A47B 47/05 217/65 |
| 3,285,684 | A * | 11/1966 | Duncan | A47B 47/04 217/7 |
| 3,326,149 | A | 6/1967 | Mitchell et al. | |
| 3,347,610 | A | 10/1967 | Pilliod | |
| 3,360,320 | A * | 12/1967 | Lust | A47B 47/03 312/265 |
| 3,429,631 | A | 2/1969 | Neyroud | |
| 3,674,328 | A | 7/1972 | White et al. | |
| 3,713,718 | A | 1/1973 | Lucci | |
| 3,722,971 | A | 3/1973 | Zeischegg | |
| 3,743,373 | A * | 7/1973 | Camper | A47B 47/05 108/158.12 |
| 3,784,273 | A | 1/1974 | Nikolai | |
| 3,837,721 | A | 9/1974 | Manlove et al. | |
| 4,235,493 | A | 11/1980 | Bridges et al. | |
| 4,288,137 | A | 9/1981 | MacDonald | |
| 4,378,137 | A | 3/1983 | Gibson et al. | |
| 4,690,467 | A | 9/1987 | Imbert | |
| 4,691,644 | A | 9/1987 | Frydman | |
| 4,974,912 | A | 12/1990 | Rask et al. | |
| 5,350,227 | A | 9/1994 | Katz | |
| 5,803,561 | A | 9/1998 | Puehlhorn | |
| 5,930,883 | A | 8/1999 | McWhirt et al. | |
| 6,224,175 | B1 | 5/2001 | Schmidt | |
| 6,494,551 | B1 | 12/2002 | Markley | |
| 6,722,750 | B2 | 4/2004 | Chan | |
| D514,353 | S | 2/2006 | Nowotarski et al. | |
| 7,163,109 | B2 | 1/2007 | Wells et al. | |
| 7,207,636 | B2 | 4/2007 | Livingston | |
| 7,213,895 | B2 | 5/2007 | Wu | |
| D557,034 | S | 12/2007 | Wells | |
| 7,306,299 | B2 * | 12/2007 | Wells | A47B 47/042 312/257.1 |
| D563,771 | S | 3/2008 | Prechtel et al. | |
| 7,451,535 | B2 | 11/2008 | Wells et al. | |
| 7,631,952 | B2 | 12/2009 | Chiang | |
| 9,596,933 | B2 | 3/2017 | Bader | |
| 2004/0239215 | A1 | 12/2004 | Sergeant | |
| 2006/0029730 | A1 | 2/2006 | Campbell et al. | |
| 2006/0029791 | A1 | 2/2006 | Cambell et al. | |
| 2006/0273085 | A1 * | 12/2006 | Casto | B27G 13/002 220/62 |
| 2012/0306329 | A1 | 12/2012 | Bader | |
| 2013/0057125 | A1 * | 3/2013 | Ma | F16B 12/2036 312/108 |

FOREIGN PATENT DOCUMENTS

| | | |
|---|---|---|
| GB | 2450129 | 12/2008 |
| WO | WO 92/19874 | 11/1992 |

OTHER PUBLICATIONS

International Preliminary Report on Patentability for International (PCT) Patent Application No. PCT/US2012/040514, dated Dec. 12, 2013, 11 pages.

Official Action for Australia Patent Application No. 2012261999, dated Jun. 29, 2016 3 pages.

Notice of Acceptance for Australia Patent Application No. 2012261999, dated Jun. 28, 2017 3 pages.

Extended Search Report for European Patent Application No. 12792629.3, dated Jun. 23, 2015 9 pages.

Notice of Grant for European Patent Application No. 12792629.3, dated Jun. 12, 2017 6 pages.

International Search Report and Written Opinion for International (PCT) Patent Application No. PCT/US2013/043514, dated Oct 22, 2013, 13 pages.

International Preliminary Report on Patentability for International (PCT) Patent Application No. PCT/US2013/043514, dated Dec. 11, 2014, 12 pages.

Official Action for U.S. Appl. No. 13/486,730, dated Aug. 17, 2012 25 pages.

Official Action for U.S. Appl. No. 13/486,730, dated Jan. 16, 2013 16 pages.

Official Action for U.S. Appl. No. 13/905,461, dated Jun. 12, 2014 17 pages.

Official Action for U.S. Appl. No. 13/905,461, dated Mar. 27, 2015 21 pages.

Official Action for U.S. Appl. No. 13/905,461, dated Oct. 1, 2015 15 pages.

Official Action for U.S. Appl. No. 13/905,461, dated Jul. 15, 2016 16 pages.

Notice of Allowance for U.S. Appl. No. 13/905,461, dated Nov. 8, 2016 8 pages.

* cited by examiner

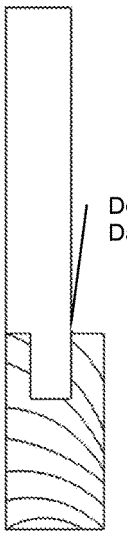
FIG. 9A
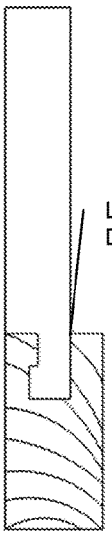
FIG. 9B
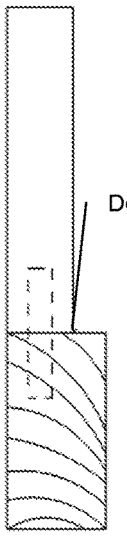
FIG. 9C
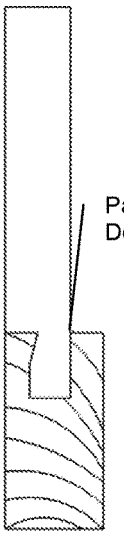
FIG. 9D
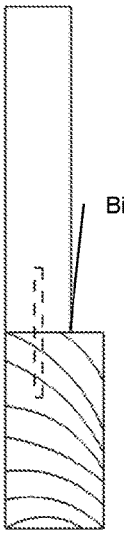
FIG. 9E
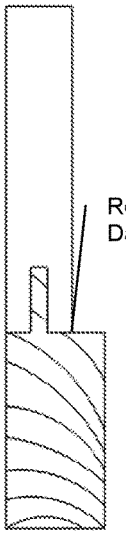
FIG. 9F
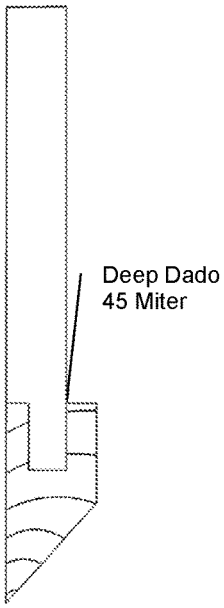
FIG. 9G
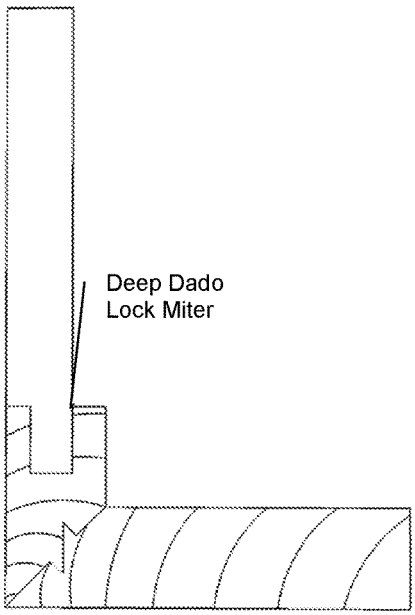
FIG. 9H
FIG. 9

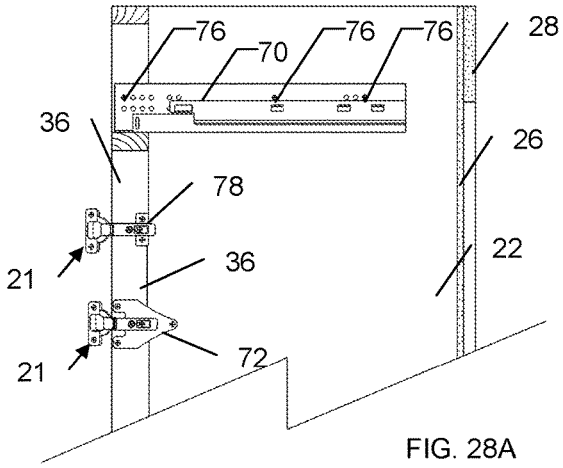
FIG. 28A
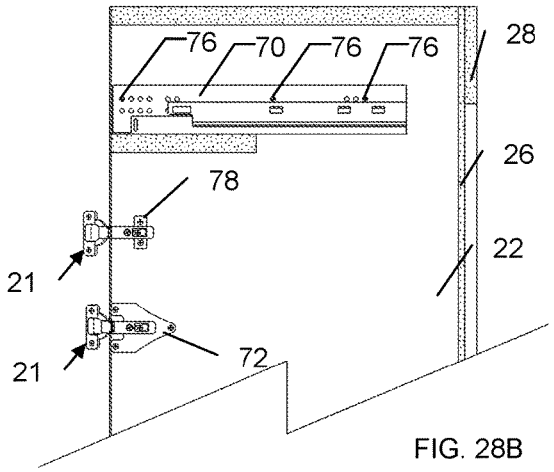
FIG. 28B
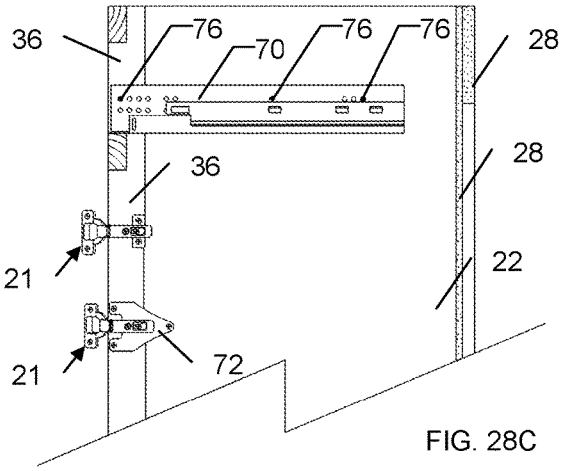
FIG. 28C
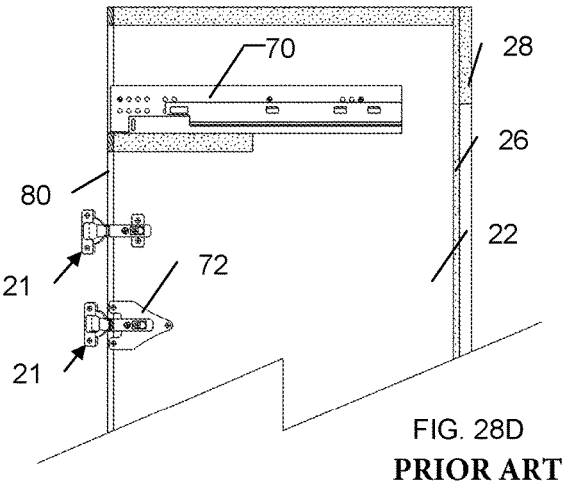
FIG. 28D
PRIOR ART
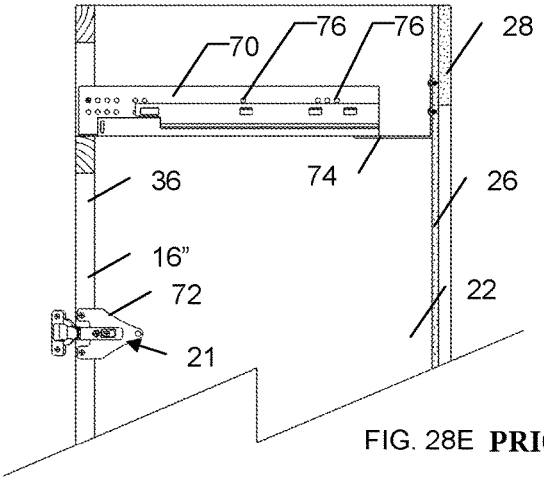
FIG. 28E PRIOR ART

PRIOR ART FIG. 30B

FIG. 32B PRIOR ART

SEMI-FULL ACCESS AND FULL ACCESS FRAMED CABINETRY

CROSS-REFERENCE TO RELATED APPLICATIONS

This application is a continuation application of U.S. patent application Ser. No. 13/905,461 filed May 30, 2013, which is continuation-in-part of U.S. patent application Ser. No. 13/486,730 filed Jun. 1, 2012, which claims the benefit of U.S. Provisional Application Ser. Nos. 61/492,049 filed Jun. 1, 2011 and 61/599,739 filed Feb. 16, 2012, the entirety of each is incorporated herein by this reference.

The following relates to framed cabinetry and more specifically relates to novel and improved face frames for cabinets which enable substantially increased access through the front opening into the interior of the cabinet over traditional framed cabinets.

BACKGROUND

Traditional framed wood cabinets have supporting face frames which are typically made up of narrow depth rectangular strips of hardwood surrounding the cabinet box front opening. Cabinet carcasses or cabinet boxes were usually constructed separately from the face frame. The face frame provides stability and integrity to the overall cabinet, as well as the ability to adjust and maintain the squareness of the cabinet box. The face frame also provides a surface on which to mount hinges for doors. The frame is assembled as one complete unit by connecting multiple solid wood members together and then applying the frame to the cabinet box at final assembly. Materials other than solid wood may be used for the frame. An example of a face frame is shown in FIG. 1. As illustrated, the vertical stiles and horizontal rails that comprise the frame have a depth "d" that is less than the width "w".

More recently, with the introduction of modern engineered wood, such as particle board and fiberboard, cabinet boxes can be made more square. However, the face frame members, namely, the vertical "stiles" and horizontal "rails" protrude into and overlap the entrance or front opening of the cabinet and interfered with access to the cabinet interior. Moreover, the narrowed openings created by the face frame further reduce the volume and accessibility of space available for shelves, drawers and internal accessory components, resulting in wasted interior space. A more extensive discussion of the distinctions in cabinet construction can be found in Wikipedia under "Kitchen Cabinet," the entirety of which is incorporated herein by reference.

FIGS. 2 and 3 illustrate two embodiments of a traditional framed base cabinet which is broadly comprised of a generally rectangular box panel assembly 10, a face frame made up of a top rail 12, bottom rail 14 and vertical stiles 16. Door 18 is hinged, as at 20, to an inner vertical edge of one of the stiles 16. The box panel assembly 10 is representative of any number of different box panel constructions and is broadly comprised of opposite side panels 22, bottom panel 24 and rear panel 26 in FIG. 2. As illustrated in FIG. 3, rear top and bottom nailers 28 are affixed to and positioned behind rear panel 26 and extend between upper and lower corners of the side panels 22 for facilitating connecting the box panel assembly to a wall. Alternatively, the nailers 28 may be replaced by a thicker rear panel. A top panel is not required because of the presence of the face frame.

With reference primarily to FIGS. 2, 3 and 3A, in the traditional framed cabinet as shown, the stiles 16 are of generally rectangular cross-sectional configuration with the longer dimension "w" extending perpendicular to the side panels 22 and parallel to the opening of the cabinet and the shorter dimension "d" extending parallel to the side panels 22 and perpendicular to the opening of the cabinet. As shown in FIG. 3A, in most framed cabinets the outer vertical edges 16' of the stiles 16 extend beyond the outer surface of the side panels 22 by a dimension "x" of approximately 3/16 to ¼ inch. As shown in FIG. 3B, in some cabinets, the outer vertical edge 16' is substantially flush with the outer surfaces of the side panels 22. The inner edges 16" of the stiles 16 project inwardly across the front opening in the box panel assembly and beyond the inner surfaces of the side panels 22. Typically, the stiles will extend in both directions beyond the inner and outer surfaces of the side panels for a distance at least as great as the thickness of the side panels. Thus, with reference to FIG. 3A, the dimension "x" is greater than or equal to the width thickness "t" of the side panel. The upper and lower rails 12, 14 will be joined to the inner facing edges 16" of the stiles at the upper and lower front corners. As a result, as shown in FIG. 3, the width of the front opening between the side panels 22 (w') will be reduced by the stiles 16 to a width (w") and will not only restrict the access into the interior of the box panel assembly but the offset between the stiles and side panels will limit the type of hinges 20 utilized. In particular, the attachment surface for a hinge is limited to the inner surface 16" of the stile. Furthermore, the standard or traditional type of stile imposes a restriction on the mounting of shelving, drawers and internal accessory components such as trash bins and the like, within the interior space of the cabinet. For example, drawers and other extendable and retractable accessories cannot attach to the inner surface of the side panel because the overhang of the stiles blocks a drawer guide from extending out from the interior space of the box panel assembly. In other words, the width dimension of a drawer or accessory is limited by the opening in the frame (w") rather than the width of the interior space of the cabinet (w'). As a result, functional space is lost.

In contrast, and in an attempt to overcome the limitations of face frame cabinets, frameless cabinets were developed in Europe following World War II. Frameless or full access cabinets utilize thicker, engineered wood, such as particle board, plywood or fiberboard to construct a cabinet box without a face frame. Top panels or stretchers are required and the side, top and bottom panels made of such thicker wood products provide the needed stability and reinforcement provided by the face frames in traditional cabinets. By eliminating the face frame, frameless cabinet boxes result in better utilization of interior space than the face frame cabinet boxes, among other advantages. Nevertheless, frameless cabinet boxes also have disadvantages, including requiring the use of thicker, heavier panels to achieve satisfactory stability and a top panel or stretcher to maintain squareness of the cabinet box due to the absence of a face frame. As used herein, the term cabinet box includes box panel assemblies with or without doors, including cabinets and bookcases. In addition, another disadvantage is the lack of a uniform aesthetic appearance to the front of the cabinet box, especially when adjacent cabinet boxes, bookcases or fillers are made from different materials. Plastic or wood corner blocks may also be needed for additional squareness and rigidity.

A further and more recent attempt to address cabinet construction has resulted in the introduction of a semi-frameless cabinet. Examples of semi-frameless cabinets are found in U.S. Pat. Nos. 7,306,299 and 7,451,535, owned by MasterBrand Cabinets, Inc of Jasper, Ind. Semi-frameless cabinets are made using the frameless cabinet model, but relatively thin wood veneers or edge strips are added to the front edge of the side, top and base panels to provide for a more finished "frame-like" appearance to the front of the box panel assembly or cabinet box. FIGS. 4 and 5 illustrate a semi-frameless construction. A veneer or aesthetic edge piece 80 is applied individually to each side panel 82, top panel 84 and bottom panel 86 for finishing purposes. There is no construction of a separate frame. The edge strips or pieces of veneer 80 are not joined together to form a frame prior to being attached to the panels 82, 84 and 86. The veneers 80 provide no structural support or integrity to the cabinet. Rather, the veneers 80 are purely aesthetic. While this method of cabinet construction is touted as more efficient, for example, because the panels may be made ahead of time, stored in inventory, and assembled into cabinet boxes as needed, there are a number of disadvantages to a semi-frameless cabinet of this type. For example, as with any frameless cabinet, a top panel or stretch 84 is required. A top panel 84 is required to complete the full perimeter edge of the cabinet box.

In addition, compared to a framed cabinet box, thicker panels are required in a frameless cabinet box. This necessarily adds weight and cost to the end cabinet box. In addition, the width of a cabinet box made in this manner is limited. The horizontal panels or stretchers will sag or bend under their own weight, or due to the weight of objects placed thereon, if the width spans a greater distance. Such sagging may also compromise drawer construction and operation. Further still, because each panel 82,84 and 86 has a separate veneer 80 on the front edge, cabinet boxes made in this manner have a lower aesthetic quality. This latter disadvantage results from the way in which frameless cabinet boxes are made and assembled. Typically, a wood veneer is affixed to the front edge of the side, top and bottom panels to give the front of the frameless cabinet box an aesthetic wood appearance. The veneer is added to each of the cabinet box panels separately. Often the individual panels are made separately and stored in inventory for later assembly. Thus, it is not unusual for the front aesthetic veneers to vary in color not only within one cabinet box but also within adjacent cabinet boxes. Further still, there will always be seams between each discrete edge or piece of veneer 80 where one panel is positioned adjacent to another panel. In addition, there is no ability to have a single piece rail or horizontal edge of any relatively long distance, such as is the case with a row of adjacent cabinets or bookcases joined together, because each horizontal rail of each cabinet box is made with a separate piece of veneer. Nor is there any ability to add custom detailing, such as by routing, to any length of horizontal rail. In addition, there is no ability to add a custom extension, for example, when spanning a gap to abut a wall or when dealing with a non-plumb wall surface, or to eliminate a toe kick, without creating more seams.

In view of the foregoing, there continues to be a need for framed cabinets, but which do not reduce the opening size of the entrance in relation to the cabinet interior, particularly across the width between the stiles. There also continues to be a need for stiles to have a deeper or longer depth to provide an extended solid wood securement surface and to accommodate a greater variety of hinges. There also continues to be a need for cabinet boxes that blend the advantages of framed and frameless cabinets while eliminating the disadvantages of both. The embodiments of the present invention solve this long-felt need.

SUMMARY

According to one embodiment of the present invention, a semi-full access framed cabinet box is provided. A semi-full access framed cabinet box utilizes a face frame. However, the vertical frame components or stiles mounted on the front of the cabinet box are inverted or rotated ninety degrees (90°), in a manner to be described below, so that the inner surface of the stile is substantially flush with the inner surfaces of the cabinet box side panel to eliminate interference and interior access issues. Yet, by retaining a face frame, necessary reinforcement or structural support to the cabinet box is provided, allowing box panels to be made from thinner, lighter and less expensive components and, if desired, eliminated the need for a top panel. Moreover, by inverting the stile orientation ninety degrees (90°), the dimension of the stiles is longer in depth (parallel to the surface of the side panels) than width. The additional depth enables and enhances mounting of hardware, such as Euro-hinges and drawer guides, flush to the interior surface of the frame stile rather than the interior surface of the side panels. Mounting the hinges and drawer guides to a solid wood frame member instead of a non-solid wood side panel provides a superior longer lasting mounting. In this embodiment, it should be appreciated that the top and bottom rails are not reoriented or inverted so that the access or opening size is increased only across the width of the entrance.

In accordance with the first embodiment, in another aspect of the invention, a method of making and assembling a framed cabinet is provided, the method comprising:

obtaining a box panel assembly including two side panels, a bottom panel, and a rear panel, each panel having an inner surface and an outer surface, wherein when assembled the inner surface of each panel faces an interior space defined by the box panel assembly and the outer surface of each panel forms an exterior surface of the box panel assembly, the box panel assembly having a front end with an opening having a height and a width;

obtaining at least two stiles and at least two rails, the stiles and rails each having a generally rectangular cross section, the stiles and rails each having an inner surface and an outer surface spaced apart from each other and two opposed end surfaces spaced apart from each other, wherein the inner and outer surfaces are wider that the end surfaces;

attaching a first stile to the front edge of a first side panel such that the inner surface and outer surface are oriented approximately parallel to the side panel and a the end surfaces are oriented approximately perpendicular to the side panel;

attaching a second stile to the front edge of a second side panel such that the inner surface and outer surface are oriented approximately parallel to the side panel and a the end surfaces are oriented approximately perpendicular to the side panel;

attaching a first rail to the front edge of a bottom panel;

assembling the side panels, bottom panel and rear panel into a box shape such that the first rail extends between the two stiles;

positioning a second rail between the two stiles and spaced from the first rail;

interconnecting the first and second rails to the first and second stiles for form a face frame at the front end of the box panel assembly, whereby the orientation of the two stiles permit substantially full access into the interior space of the box panel assembly across the width of the opening, and whereby the face frame provides structural support to the panel assembly to permit utilization of a box panel assembly.

According to a second embodiment, a full access framed cabinet box is provided. In this embodiment, a face frame is also provided but both the stiles and rails are inverted or rotated ninety degrees (90°) so that the inner surfaces are substantially flush with the interior panel surfaces without substantial or significant overlap. In full access framed cabinet boxes the stiles and rails generally are deeper than they are wide. In other words, the frame members generally retain their overall rectangular cross-section, but the longer dimension is in the direction of the depth of the cabinet—extending in the same direction as the respective interior and exterior surfaces of the panels to which they are attached.

In accordance with the second embodiment, the method of making and assembling the cabinet box may be quite similar, except that the horizontal frame members or rails are oriented with the longer dimension parallel to the bottom panel. Alternatively, the face frame may be fully assembled and aesthetically finished and in a subsequent step affixed to the cabinet box as a single piece.

With regard to semi-full access or full access framed cabinet boxes, it should be appreciated that the stiles or rails need not be absolutely flush with the panel surfaces but may have a slight overlap. This enables placement of a skin or finishing veneer on the inner and outer surfaces of the panels in the event of scratching, damage, etc. The slight exterior overlap of the inner surface with respect to the inner surface of the panel also prevents scoring or gouging of the edges of the side panels, for example, when the drawers or internal fittings are being mounted. The slight overlap exterior overlap of the outer surface of the stile relative to the outer surface of the side panel permits a veneer to be added to the outer surface of the side wall of an end cabinet to cover scratching or damage incurred during shipping and installation.

With either semi-full access or full access framed cabinet boxes, it should be appreciated that different dimensioned frame members may be utilized as may be appropriate for the final installation. Thus a bottom frame member or rail associated with a base panel may extend to the floor in situations where a toe kick is not desired. Similarly, stiles or frame members associated with side panels may extend laterally outwardly to fill gaps between adjacent cabinets or between an end cabinet and a wall. In each of these scenarios, by utilizing a single solid wood piece, seams are eliminated and a higher custom finish is achieved. Similarly, rails and stiles may be customized such as with routing to add aesthetic detail. In the same light, a single continuous solid wood frame member may extend across a row of multiple cabinets and/or bookcases to provide a uninterrupted valance and decorative rail elements, particularly with open face cabinet boxes, without adding cost or complexity, but eliminating seams and non-matching finishes. Further still, the frame may be stained and finished all at one time to ensure uniformity in aesthetics not only among the frame members of a single cabinet box, but also the frame members of all cabinet boxes in an overall construction project.

Accordingly, the semi-full access framed cabinetry and full access framed cabinet boxes retain a number of advantages of framed cabinet boxes over frameless cabinet boxes and incorporate access advantages of frameless cabinet boxes, while eliminating the drawbacks of standard framed cabinet boxes and standard frameless cabinet boxes. For example, framed cabinet boxes restrict the opening to the interior of the cabinet box and reduce accessibility and storage capabilities; restrict the width capacity of internal accessories due to the face frame opening restriction; and require the use of compact hinges that are not as strong and versatile as larger or European type hinges. At the same time framed cabinet boxes overcome a number of weaknesses in frameless cabinet boxes; namely, susceptibility to "racking" (being out of square) due to absence of a legitimate wood frame; use of thick and heavy panels which are required for rigidity, robustness and component connection; and use of a sealed top panel or substantial stretcher that inhibits or prevents access to the interior of the box from the top when installing and manufacturing and also adds weight and cost. In addition, manufacturing and construction of frameless cabinet boxes typically requires greater precision to achieve necessary flush front and end surfaces of the panels as there is no face frame to conceal imperfect front edges. Also because of the absence of a face frame all frameless box ends are visible. As a result, when the front ends are damaged in shipment or installation, the entire cabinet box must be replaced. Alternatively, if a veneer is applied to the box end face of a frameless cabinet, damage to the veneer would leave the front end of the damaged panel visibly exposed, thus creating an unattractive, unfinished look to the cabinet face.

In a preferred embodiment, a stile in a semi-full access frame or a stile and rail in a full access frame has a depth to width ratio of 2:1, but the ratio may vary from as little as approximately 1:1 to 3:1. Of course this does not include frame members with extended surfaces, for example as is illustrated in FIG. 24A. In a preferred embodiment, the depth is approximately 1.5 inches (3.8 cm) and the width 0.75 inches (1.9 cm). Of course, one of skill in the art, upon reading this disclosure, would appreciate that these dimensions can vary depending upon project designs and installation issues. Such variations are within the scope of the present disclosure.

Cabinet making has existed for centuries. While a long felt need has existed for greater access to and utilization of the internal volume of a cabinet and greater quality construction at reduced material and manufacturing cost, this need has not been fully or effectively satisfied by the introduction of frameless cabinets and/or semi-frameless cabinets with front edge veneers within the last half-century. As explained herein, numerous disadvantages exist with frameless and semi-frameless cabinet construction. The concepts and embodiments of the present invention overcome these known disadvantages and, in doing so, have satisfied a decades-long continuous need in the field of cabinets and cabinet making.

The above and other objects advantages and features will become more readily understood from a consideration of the following detailed description when taken together with the accompanying drawings in which:

DETAILED DESCRIPTION OF DRAWINGS

FIGS. 9A-9H are cross-sectional views of eight additional types of connections for connecting a panel to an inverted frame member.

FIG. 28A is a plan view of the inside surface of a side panel of a full access cabinet box further showing a drawer guide, 2-screw European mounting plate and 3-screw European face frame base plate attached thereto.

FIG. 28B is a plan view of the inside surface of a side panel of a frameless cabinet box further showing a drawer guide, 2-screw European mounting plate and 3-screw European face frame base plate attached thereto.

FIG. 28C is a plan view of the inside surface of a side panel of a semi-full access cabinet box further showing a drawer guide, 2-screw European mounting plate and 3-screw European face frame base plate attached thereto.

FIG. 28D is a plan view of the inside surface of a side panel of a semi-frameless cabinet box of the type shown in U.S. Pat. Nos. 7,306,299 and 7,451,535.

FIG. 28E is a plan view of the inside surface of a side panel of a traditional framed cabinet box further showing a drawer guide and European face frame base plate partially attached thereto.

Figure 29:
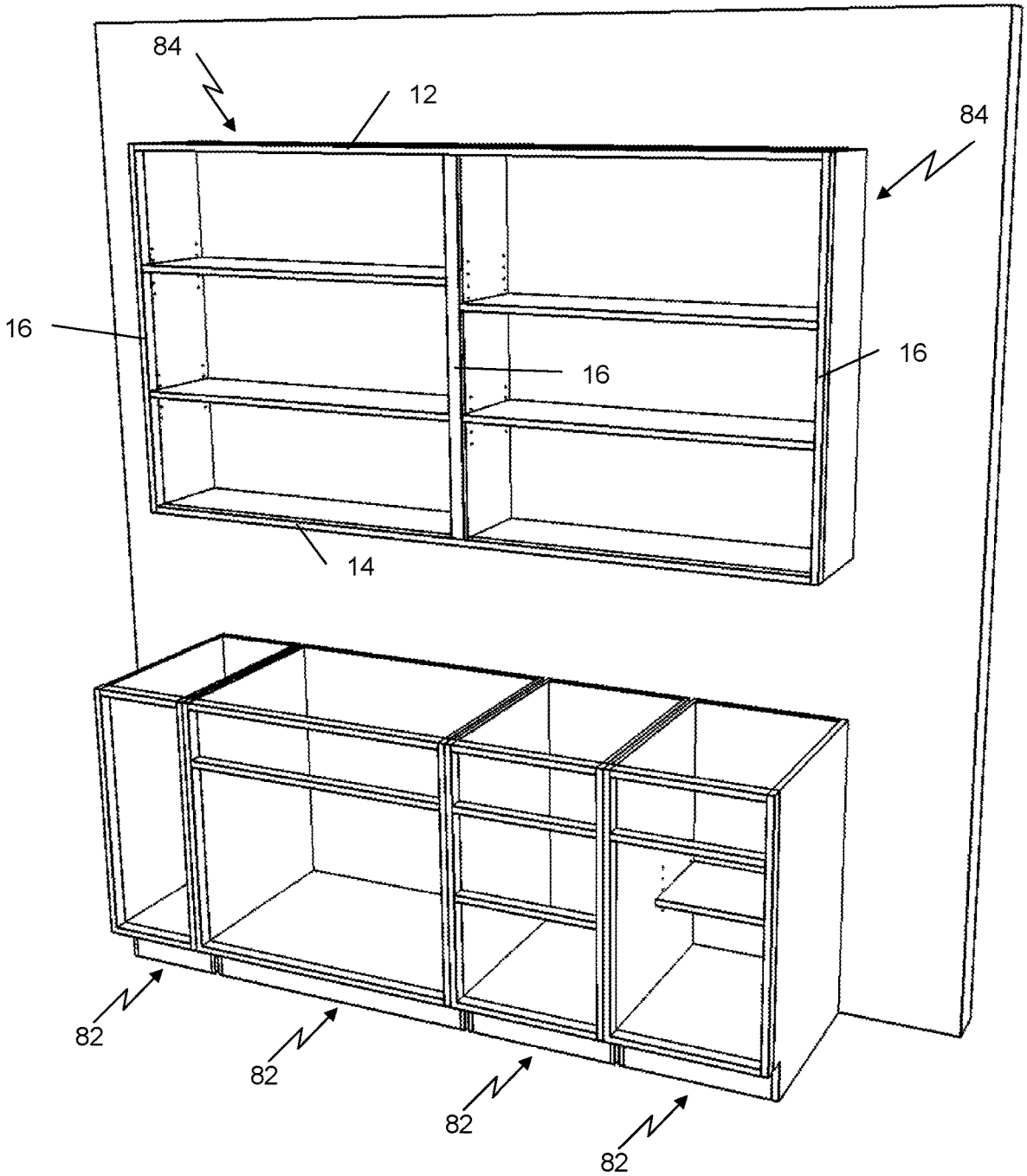

FIG. 29 is a front perspective view of a plurality of full access base cabinet boxes affixed to a wall in an installed orientation and a pair of full access upper cabinet boxes further showing an integral 1-piece top and bottom rail and single center stile affixed to a wall in an installed orientation.

Figure 30A:
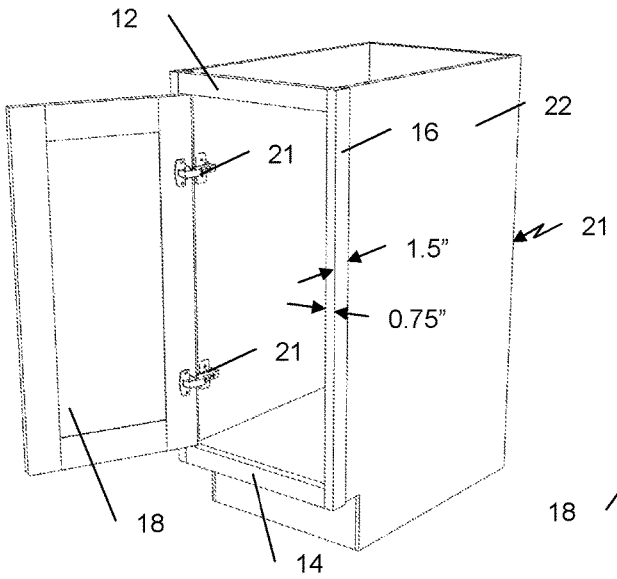

FIGS. 30A and 30B are perspective views of cabinet boxes with inset doors, with the door in an open position. FIG. 30A is a cabinet box with a semi-full access inverted face frame. FIG. 30B is a cabinet box with a traditional face frame.

Figure 31A:
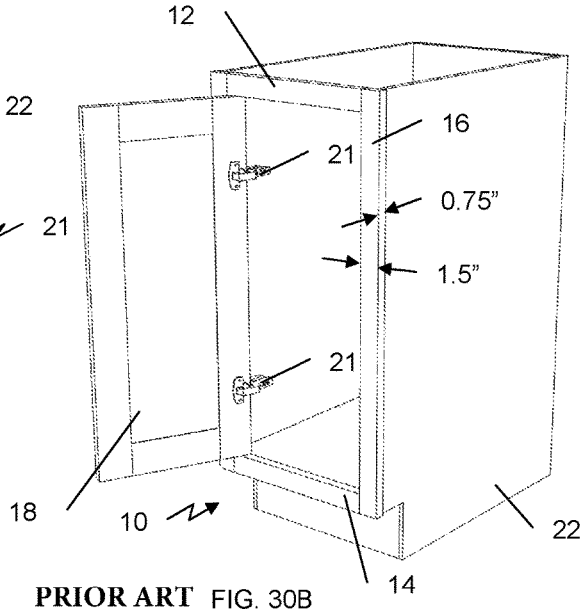
Figure 31A:
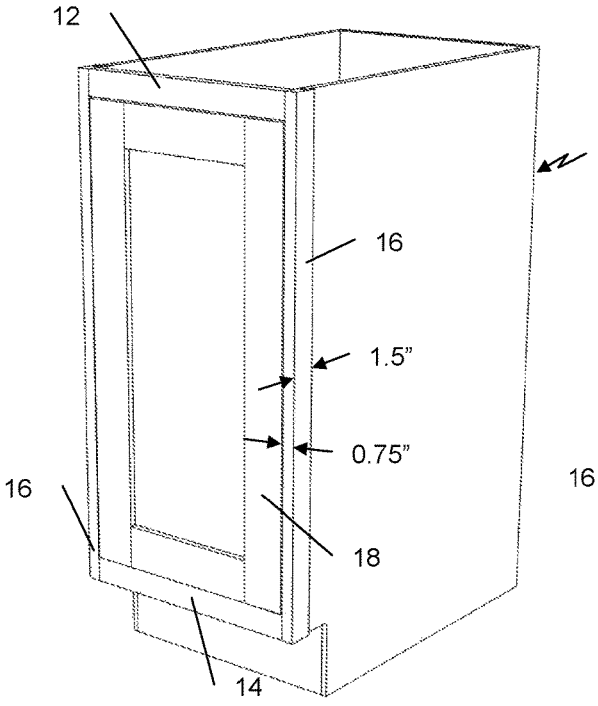
Figure 31B:
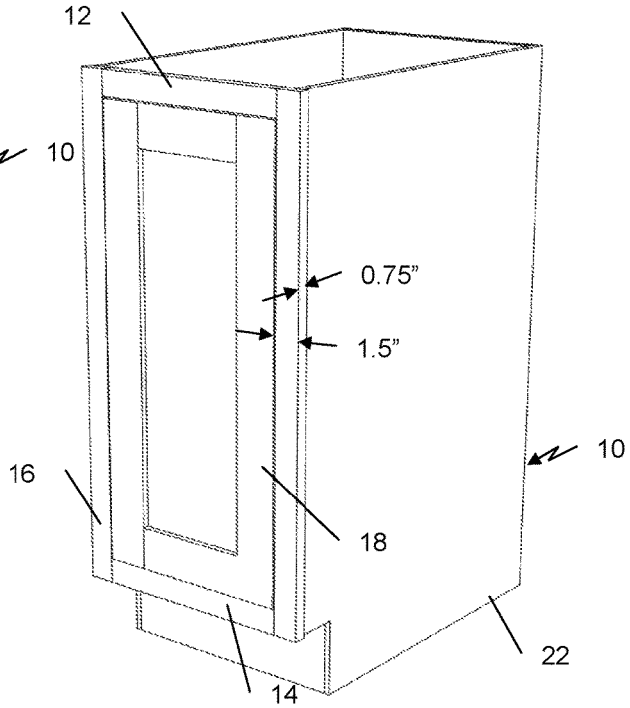
FIG. 31B PRIOR ART

FIGS. 31A and 31B are perspective views of the cabinets of FIGS. 30A and 30B, respectively, with the inset doors closed.

Figure 32A:
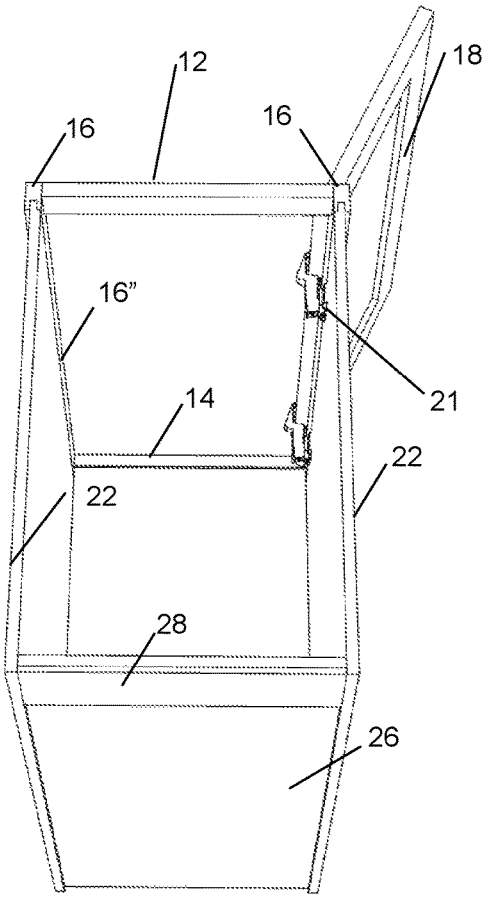

FIGS. 32A and 32B are top perspective views of the cabinets of FIGS. 30A and 30B, further showing door hinge hardware.

Figure 33A:
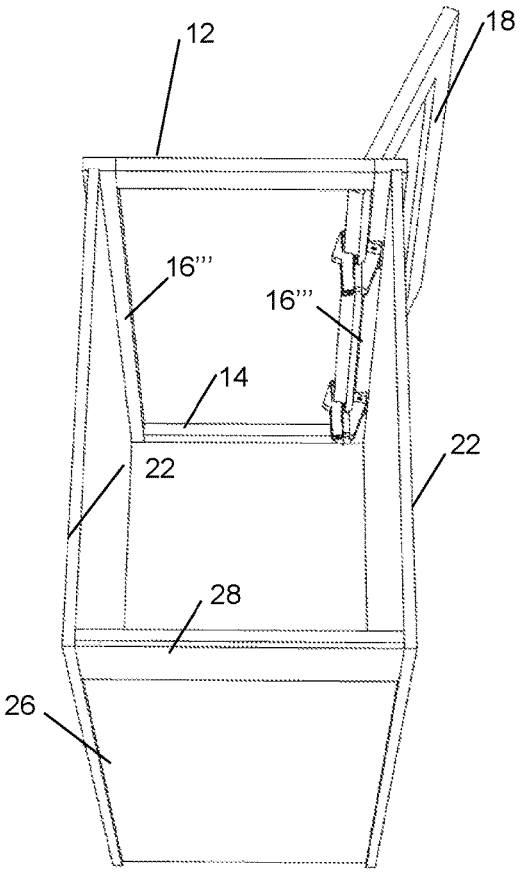
Figure 33A:
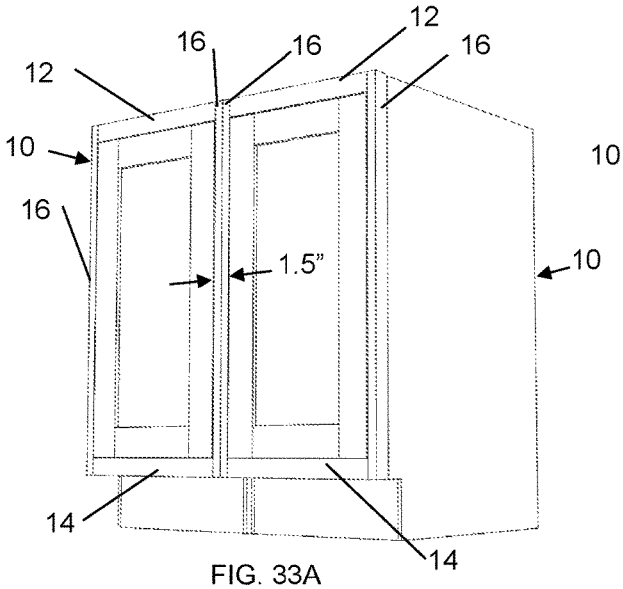
Figure 33B:
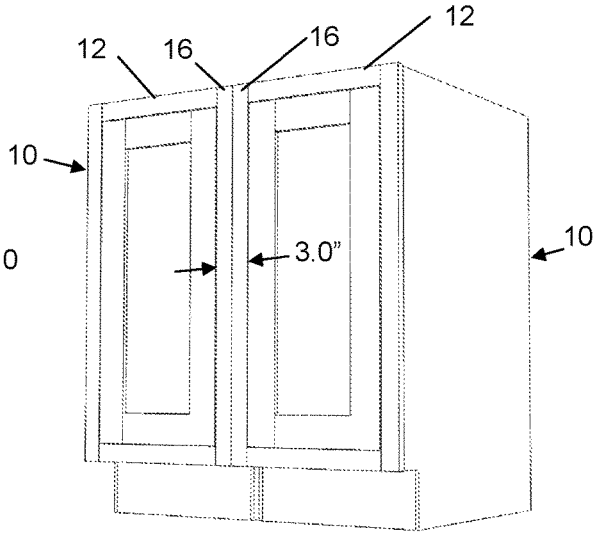
FIG. 33B PRIOR ART

FIGS. 33A and 33B are each perspective views of a pair of cabinet boxes in abutting relationship alone one side panel. FIG. 33A shows a pair of cabinet boxes with a semi-full access inverted face frames. FIG. 33B shows a pair of cabinet boxes with a traditional face frame.

It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

DETAILED DESCRIPTION

Figure 1:
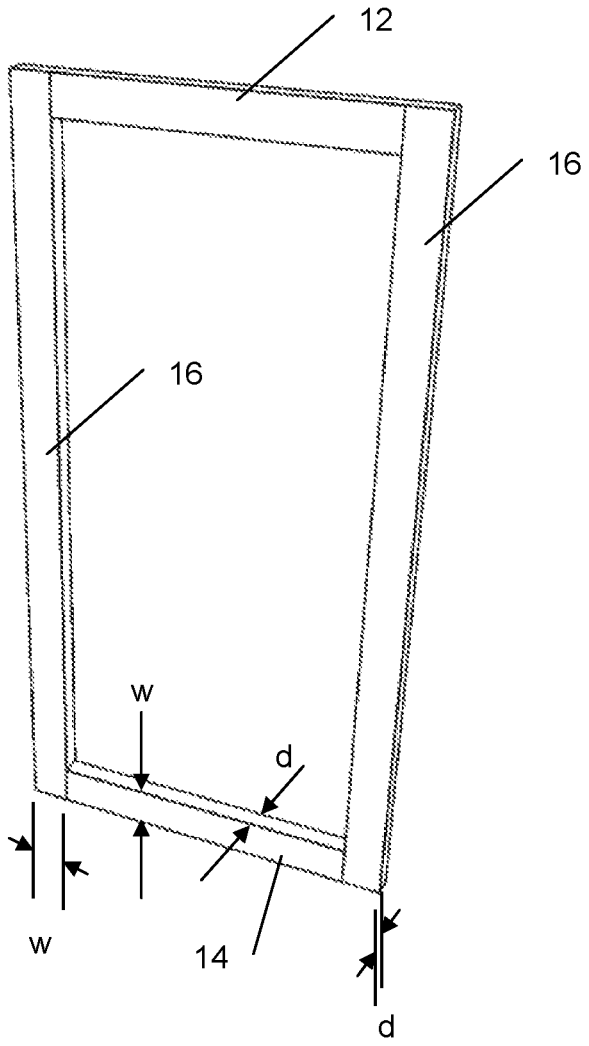
FIG. 1 is a front perspective view of a traditional face frame for a cabinet box.
Figure 2:
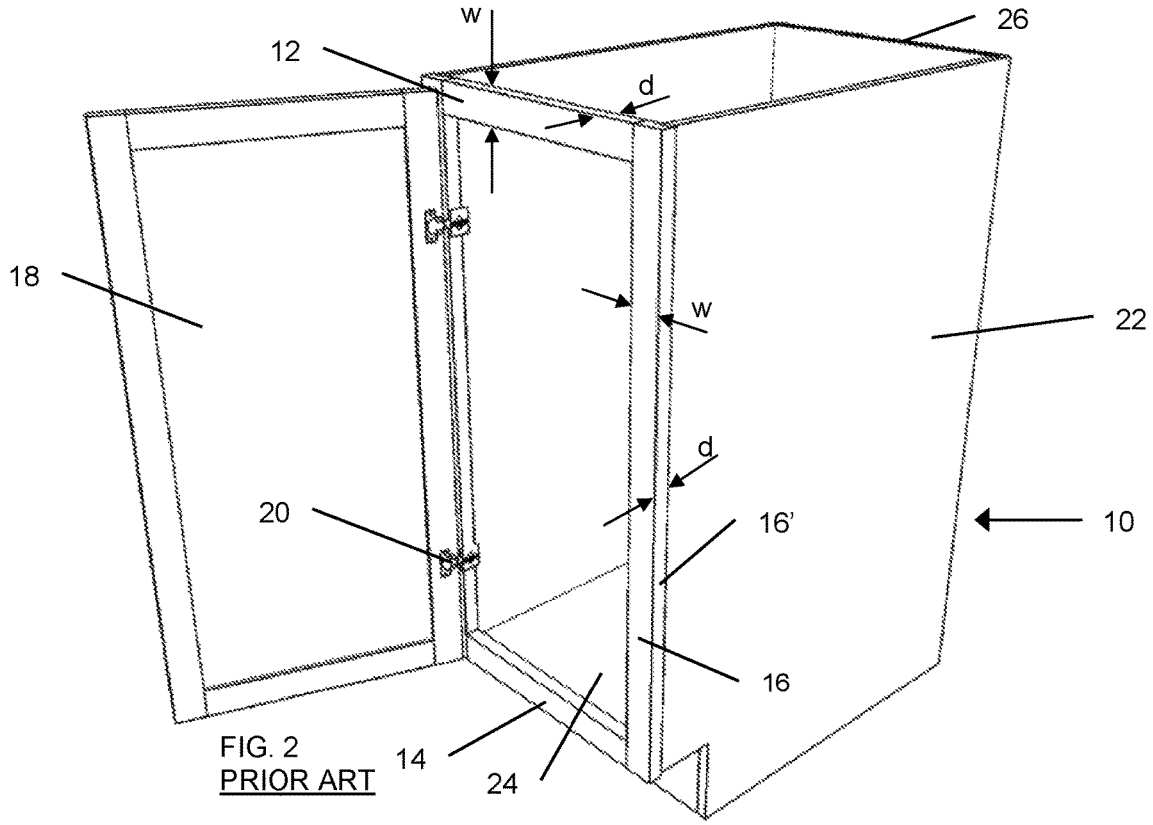
FIG. 2 PRIOR ART
FIG. 2 is a front perspective view of one embodiment of a traditional framed cabinet box.
Figure 3A:
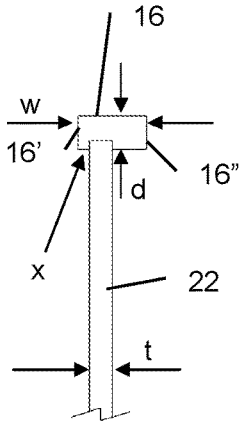
FIG. 3A PRIOR ART
FIG. 3A is a top plan view of one embodiment of a traditional frame member connected to the front end of a cabinet box panel.
Figure 3:
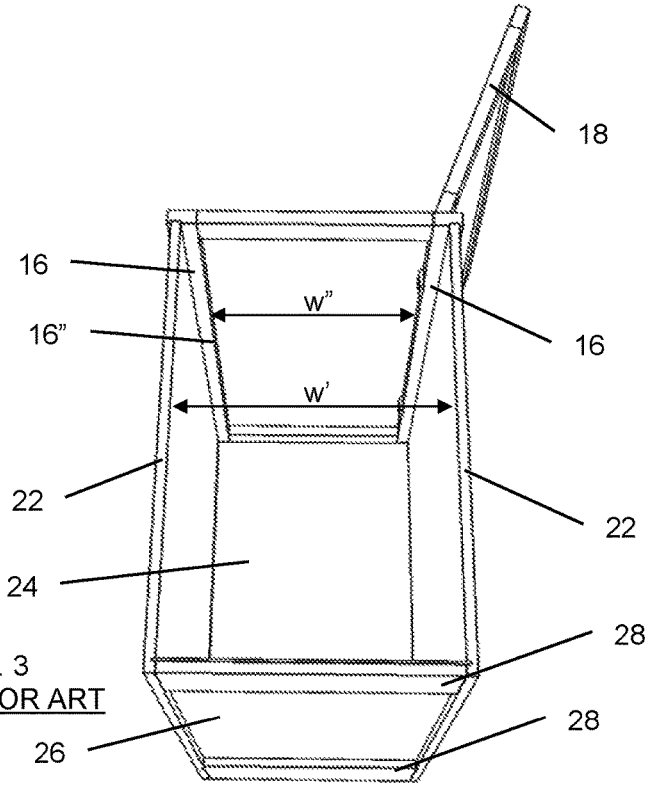
FIG. 3 PRIOR ART
FIG. 3 is a rear perspective view of the interior of an alternative embodiment of a traditional framed cabinet box.
Figure 3B:
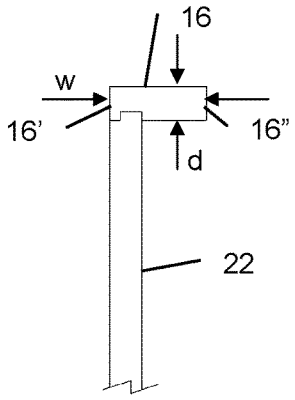
FIG. 3B PRIOR ART
FIG. 3B is a top plan view of a second embodiment of a traditional frame member connected to the front end of a cabinet box panel.
Figure 4:
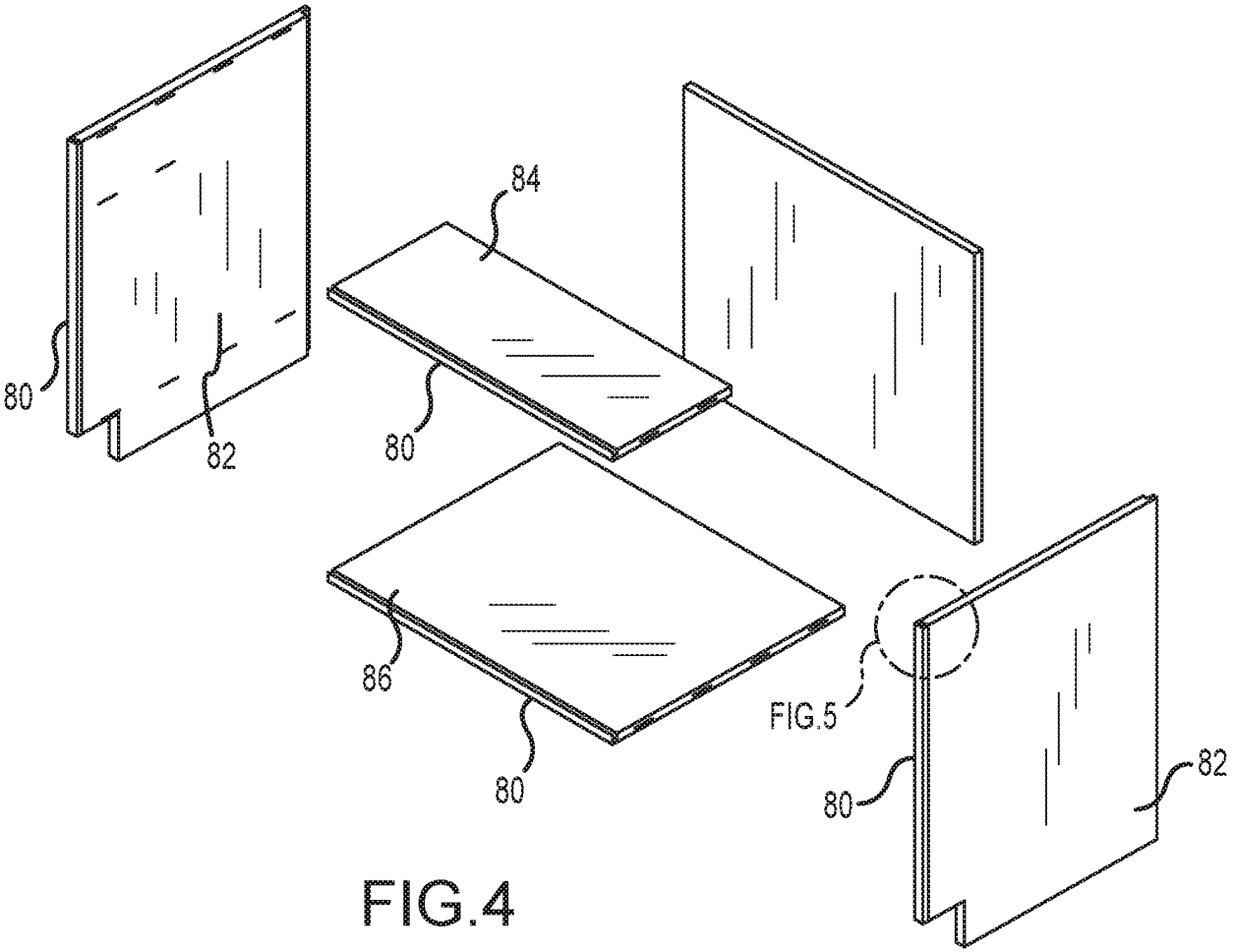
FIG.4 PRIOR ART
FIG. 4 is an exploded view of a semi-frameless cabinet box.
Figure 5:
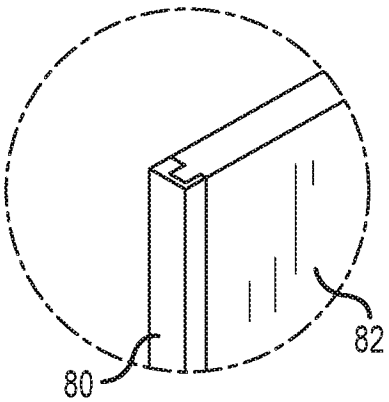
FIG.5 PRIOR ART
FIG. 5 is an expanded view of the edging material or veneer that is connected to the front edge or face of a cabinet box panel.
Figure 6:
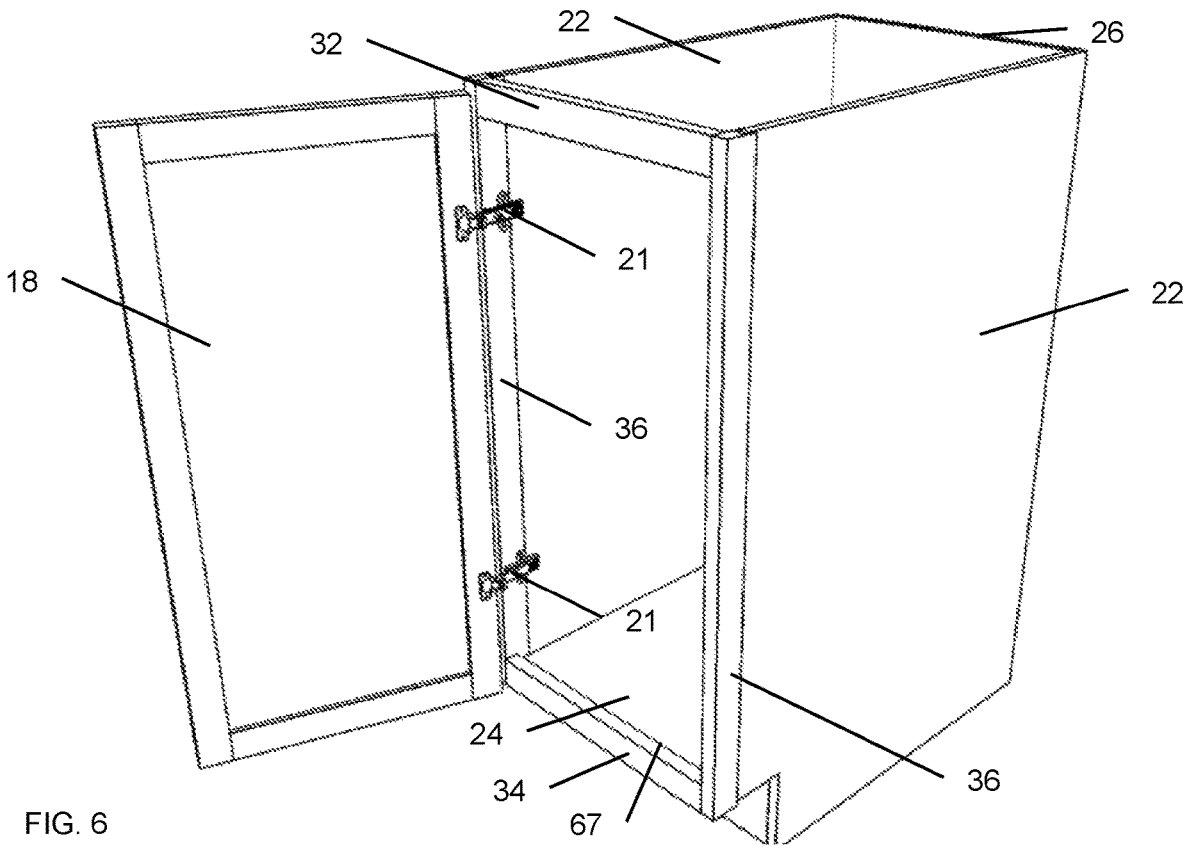
FIG. 6 is a front perspective view of one embodiment of a semi-full access framed cabinet box.
Figure 7:
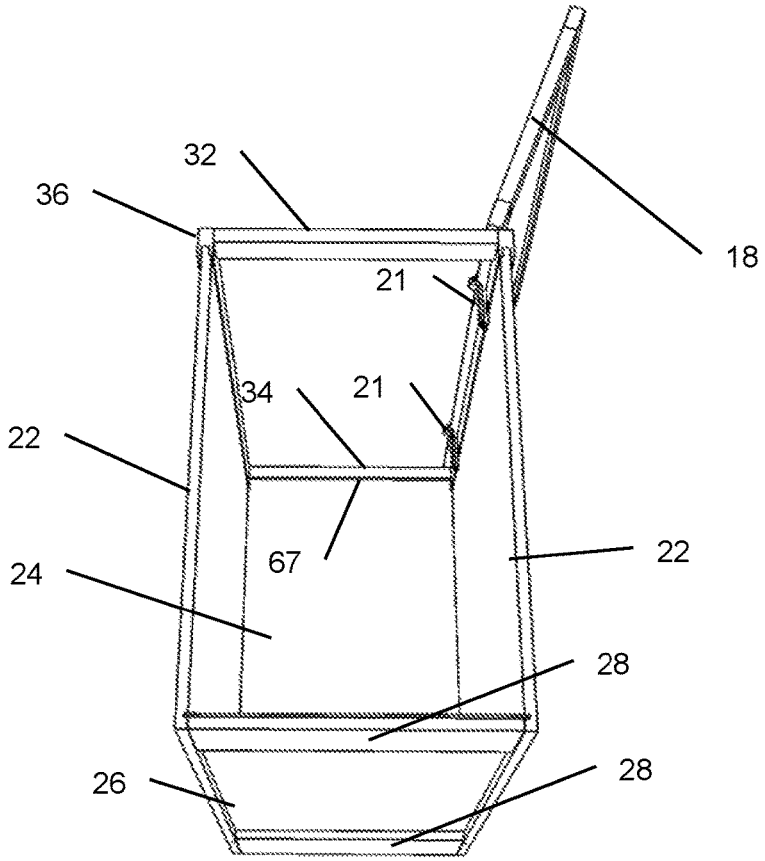
FIG. 7 is a rear perspective view of the interior of an alternative embodiment of a semi-full access framed cabinet box.
Figure 26:
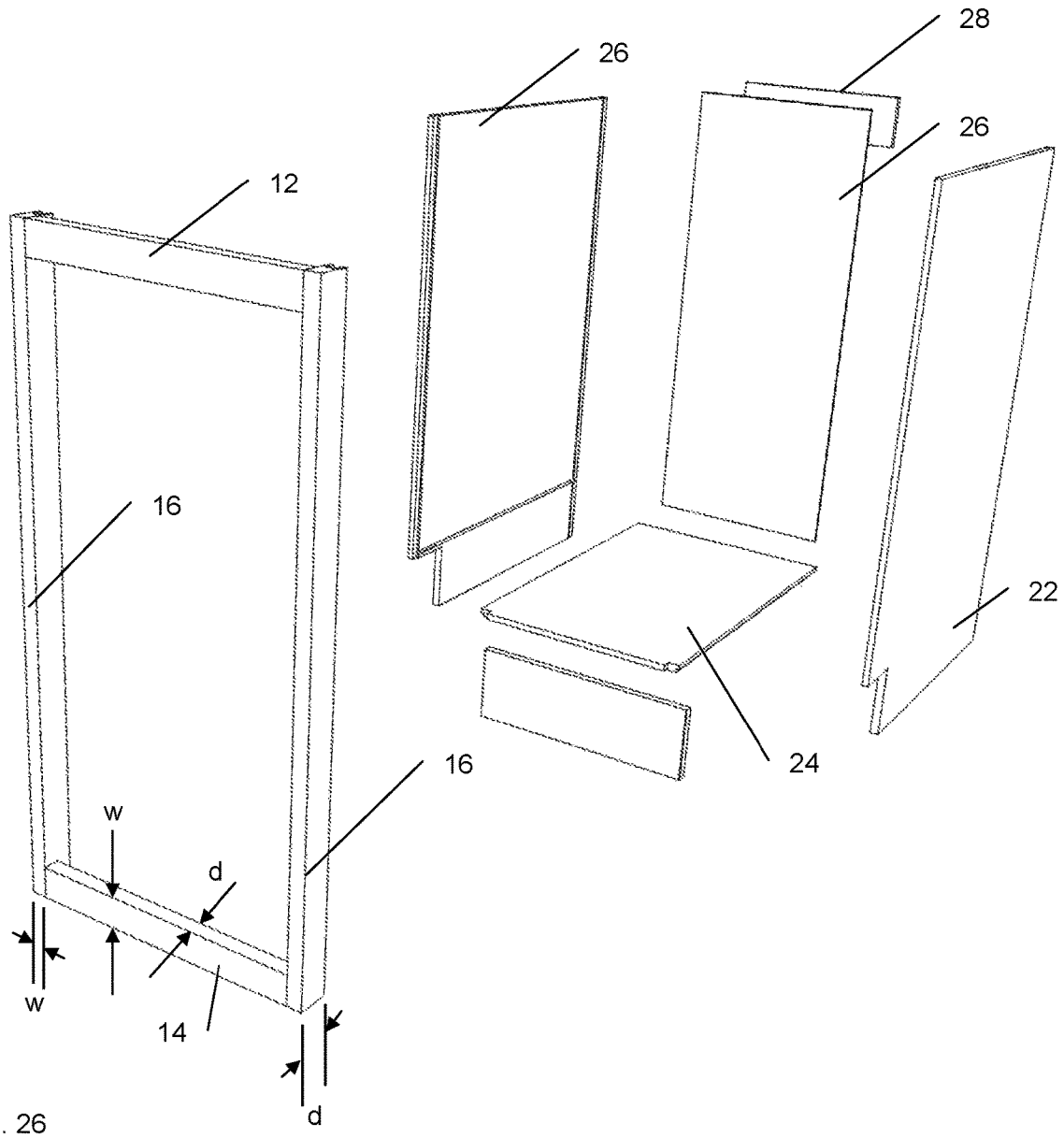
FIG. 26 is an exploded front perspective view of an assembled semi-full access frame and a cabinet box.
Figure 27:
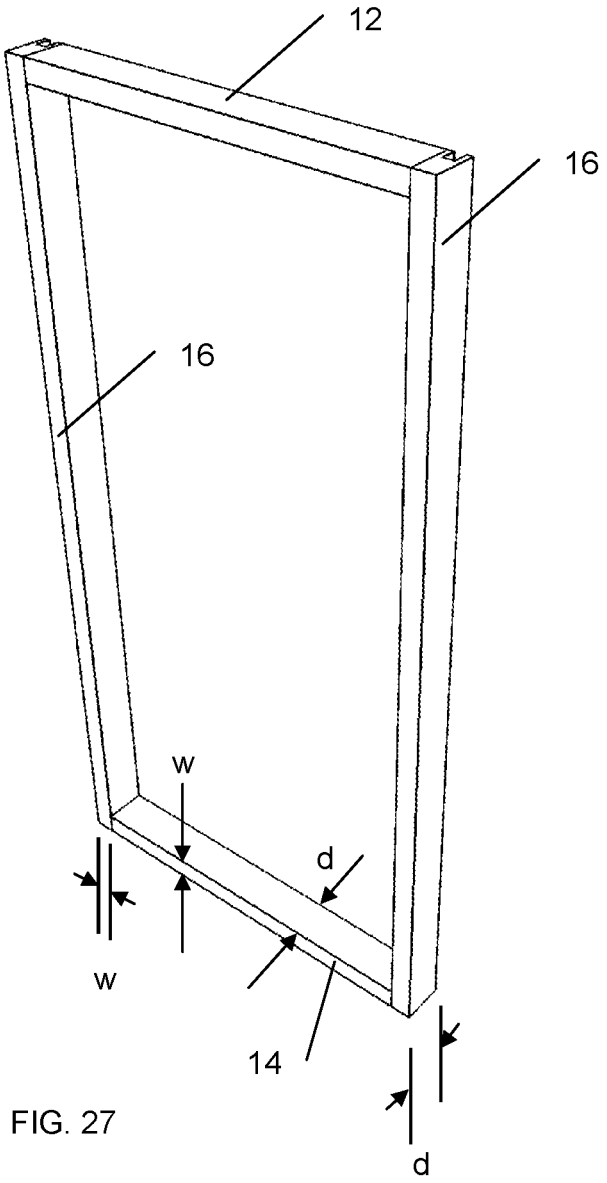
FIG. 27 is a front perspective view of an assembled full access frame for a cabinet box.

Referring to first alternative embodiments shown in FIGS. 6 and 7, like elements to those illustrated in FIGS. 2 and 3 are correspondingly enumerated. Specifically, the same box panel assembly or cabinet box 10 is comprised of the side panels 22, bottom panel 24, rear panel 26 and door 18. In FIG. 7, the rear panel 26 has rear frame members 28 placed behind it. The first embodiment illustrates a semi-full access framed cabinet in which the face frame is comprised of top and bottom rails 32 and 34, respectively, extending between front inverted stiles 36 on opposite sides of the frame. An exploded view of a semi-full access frame and cabinet is shown in FIG. 26. A full access frame is shown in FIG. 27, but without the cabinet.

Figure 8:
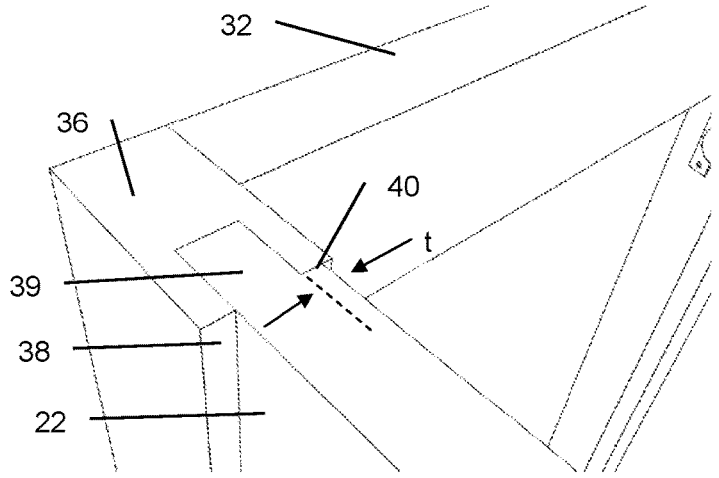
FIG. 8 is a fragmentary perspective view of a modified form of front corner detail on a semi-full access framed cabinet box of the type shown in FIGS. 6 and 7.
Figure 8A:
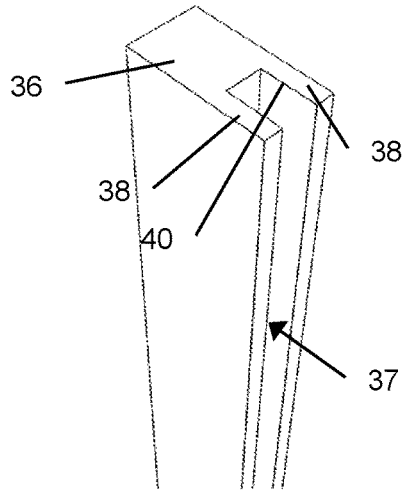
FIG. 8A is a fragmentary perspective view of the stile illustrated in FIG. 8.

As illustrated in more detail in the embodiment of FIGS. 8 and 8A, each stile 36 is formed with a dado/rabbet, the dado defined by a generally U-shaped groove 37 extending the length of the stile 36 with opposite side walls 38 on either side of the groove 37 being of substantially equal thickness and the groove 37 being dimensioned to receive a notched end 39 of each side panel 22. The notch 40 of the notched end 39 is formed along the inner surface of the front end of the side panel 22 and is generally of a thickness "t" substantially equal to that of the side wall 38 on one side of the groove 37. The opposite side wall 38 overlaps the outer surface of the side panel 22. The stiles 36 are inverted with respect to the side panels, i.e., the stiles are rotated ninety degrees (90°) relative to the orientation of a traditional stile frame member. As a result, the stiles are oriented with greater depth (in the same direction as the side panel) than in width. In other words, the larger dimension of the stile, its depth, is parallel to the side panel 22 and perpendicular to the plane defined by the opening of the cabinet box. In addition, the inner surface of each stile 36 is flush or substantially flush with the inner surface of the side panel 22 so as to afford the widest possible opening into the interior of the cabinet. A small overhang, where the stile extends slightly into the opening of the box, such as is shown in FIG. 8, may be desired to accommodate a veneer sheet as needed.

Figure 11:
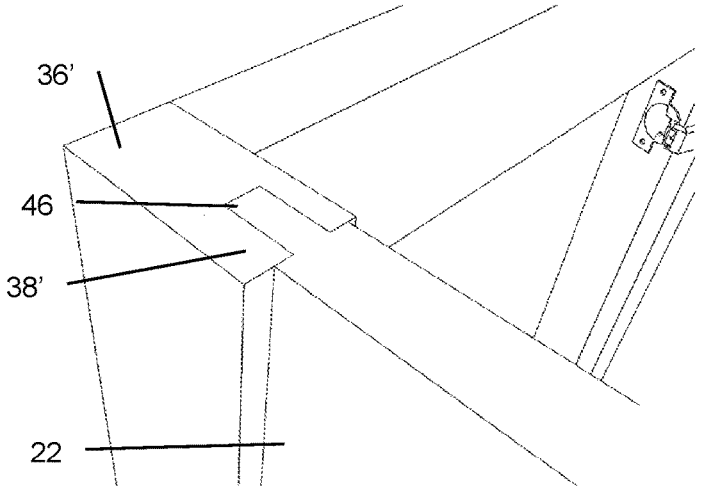
FIG. 11 is a fragmentary perspective view of still another form of corner detail in a semi-full access cabinet box of the type illustrated in FIGS. 6 and 7.
Figure 12:
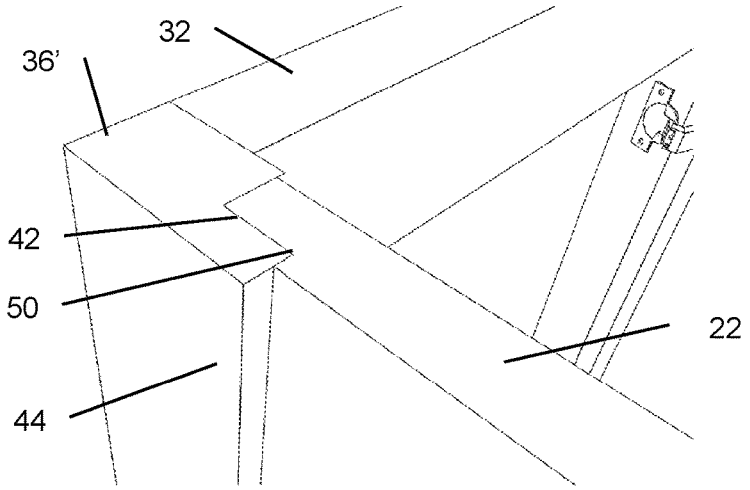
FIG. 12 is a fragmentary perspective view of another front corner detail on a semi-full access framed cabinet box of the type shown in FIGS. 6 and 7.
Figure 12A:
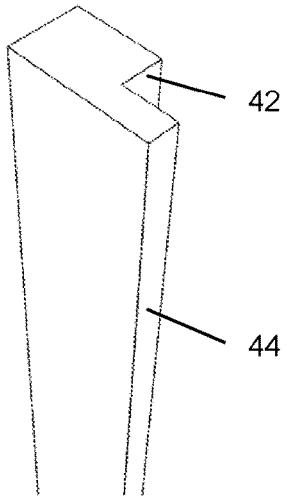
FIG. 12A is a fragmentary perspective view of the stile shown in FIG. 12.
Figure 13:
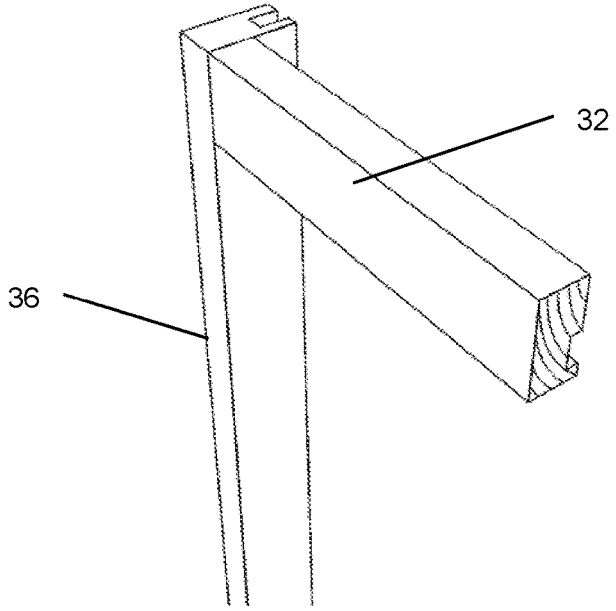
FIG. 13 is a fragmentary perspective view of a face frame rail in combination with the stile illustrated in FIGS. 12 and 12A.

In the embodiments of FIGS. 6 to 13 the rails 32 and 34 complete the face frame but are not inverted; i.e., the wider dimension extends perpendicular to the side panels 22, bottom panel 24 and top panel 26, and parallel to the plane defined by the opening of the cabinet. Conversely, the narrower dimension is parallel to the panels and perpendicular to the opening defined by the cabinet. Further, the rails are dimensioned to extend between inner surfaces of the stiles 36 and are positioned in abutting relation to the stiles 36. FIG. 13 is a fragmentary perspective view of the corner detail between a non-inverted rail 32 and inverted stile 36.

In the form of cabinet shown in FIGS. 6 and 7, a raised or stepped portion 67 may be provided by the bottom rail 34 at the front of the cabinet box to protect the bottom panel from being scraped by utensils or pots and pans when advanced into the cabinet.

In one assembly process, the panels comprising the cabinet box are joined together in accordance with well-known manufacturing practices, and the face frame is assembled to the cabinet box by gluing along the joints between the interfitting portion and the rails assembled between the stiles and temporarily secured together, such as, by gluing. Once tightly assembled together to meet dimensional requirements the frame members are permanently fastened by nails or dowels. This design preserves the strength of a traditional face frame cabinet box but gives substantially improved accessibility like a frameless cabinet box. The use of inverted frame members also permits the use of a less thick end or rear panel material because the strength of the cabinet is preserved in the frame and, to a lesser extent, the panel. In addition, because the frame stiles are oriented in an inverted position with a longer depth there are also multiple methods of securing the frame including deep dados (currently being used), lock dados, doweling, biscuits and others. Examples of these types of available connections are shown in FIGS. 9A-9F. Because of the depth of the frame material, additional frame shapes and profiles can be milled into the frame. Examples might include forty-five degree (45°) angled cabinets or lock miters joints for extended stiles and frame widths shown in FIGS. 9G and 9H. The joint technique illustrated in FIG. 9H permits laterally extending stiles of a variable lateral dimension by connecting two or more portions together to fill gaps between the cabinet box and adjacent walls or to provide an enlarged laterally extending surface for a custom finish. For example, see FIG. 24A. It should be appreciated that this type of joint may be used in connection with a stile connected to any side panel, or with a rail connected to a top panel or a bottom panel to form face frame extensions at any of these locations. Other joints types, such as shown in FIGS. 9A-9F, may also be used to form these extensions.

In addition, the longer or deeper dimension of the stiles 36 in the direction of the side panels enables a more secure mounting of a greater variety of drawer guides and hinges, including quick-release hinges 21, commonly referred to as Eurohinges, to the solid wood frame, rather than to the panels. A solid wood frame provides a more substantial mounting material for wood screws resulting in a longer lasting, more sturdy assembly. One such hinge is manufactured and sold by Grass Company of Kernersville, N.C.

FIGS. 28A-28E illustrate advantages of the semi-full access and full access face frames of the present disclosure with respect to the securement of drawer guides, hinges and other accessories compared to traditional face frame cabinet boxes, frameless cabinet boxes and semi-frameless cabinet boxes. For example, FIG. 28E illustrates a side panel 22 of a traditional face frame cabinet box, further showing a drawer guide 70 and a quick release European-style hinge 21 with a 3-screw European faceless frame base plate 72. Because the inner surface 16" of the stile 36 extends into the opening of the cabinet box (see FIGS. 3 and 3A), the drawer guide 70 must be spaced from the inner surface of the side panel 22 in order that the front end of the drawer guide can attach to the inner surface 16" of the stile 36. As a result, a custom rear mounting bracket 74 is required to secure the rear end of the drawer guide 70 to the rear panel 26 or nailer 28. Importantly, the screw holes 76 in the middle and rear end of the drawer guide cannot be used.

FIG. 28B illustrates a drawer guide 70 and quick release hinges 21 mounted on a frameless cabinet box. Here, a rear mounting bracket 74 is not needed. Rather, the drawer guide is flush mounted on the inner surface of the side frame 22. Front, middle and rear screw holes 76 may be utilized, but the screws are mounted into a panel made of plywood, particle board or some other composite material inferior to solid wood for mounting purposes. Similarly, the 3-screw European frameless base plate 74 and the 2-screw European mounting plate 78 are attached to the same panel.

FIG. 28D illustrates a semi-frameless cabinet box side panel 22 with a wood veneer front edge piece 80 of the type shown in U.S. Pat. Nos. 7,306,299 and 7,451,535. The veneer 80 is purely aesthetic and offers no structural advantage. This cabinet box is the same as a European frameless cabinet box and suffers the same disadvantages in mounting accessories such as hinges 21 and drawer guide 70.

In contrast are the semi-full access and full access cabinet boxes of FIGS. 28A and 28C, respectively. Here, stile 36 is inverted and attached to the side pane 22 such that its depth is substantially greater than stile 36 in the traditional framed cabinet box of FIG. 28E. More specifically, the front end of the drawer guide 70 is attached to the solid wood stile 36, and the entire drawer guide is mounted flush on the inner surface of the side panel 22 resulting in a longer lasting and more secure attachment. Moreover, the rear mounting bracket 74 is eliminated and the drawer itself is wider than a drawer used with a similar sized traditional framed cabinet box because the stile 36 does not extend into the open space. Further still, the 3-screw European frameless base plate 7*s* is also mounted flush with the stile 36 and side panel 22 such that all three screw holes may be used, with two screws placed in solid wood and one in the side panel further securing the frame to the cabinet. In addition, the 2-screw European mounting plate is also attached entirely to the solid wood stile 36.

Thus, it should be appreciated that a traditional face frame cannot accommodate the same quick release hinge as well or other hinges having long base plates because of the limited dimension of the frame parallel and perpendicular to the side panel and that the frameless and semi-frameless cabinet boxes do not allow for attachment to solid wood components.

Figure 10:
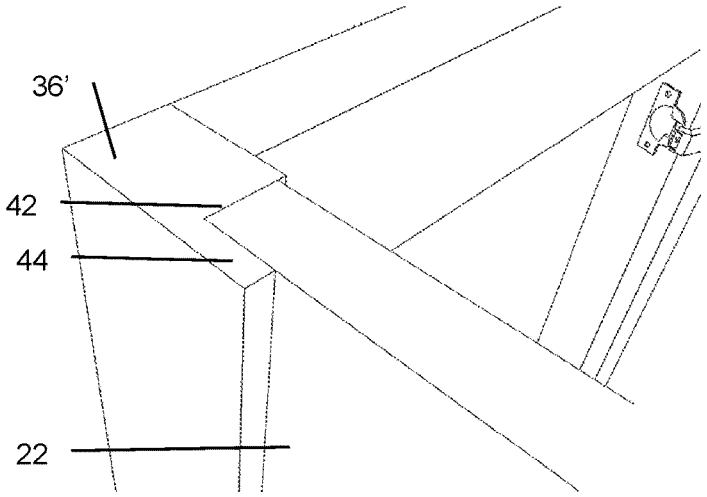
FIG. 10 is a fragmentary perspective view of another form of front corner detail for a semi-full access framed cabinet box of the type illustrated in FIGS. 6 and 7.
Figure 10A:
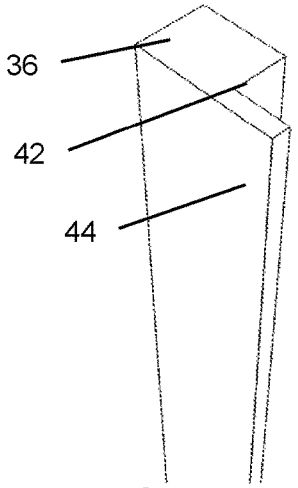
FIG. 10A is a fragmentary perspective view of the stile shown in FIG. 10.

FIGS. 10 and 10A illustrate a modified corner detail for a rabbet joint in which an inverted stile 36' is notched or recessed at 42 across its width to receive the full width of the end of the panel 22. A side wall 44 of the notched end 42 overlaps the outer surface of the side panel 22.

Figure 11A:
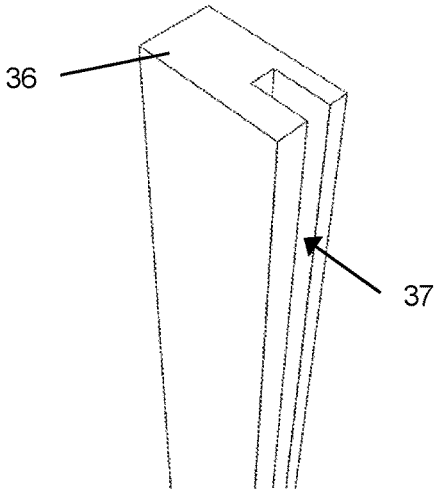
FIG. 11A is a fragmentary perspective view of the stile illustrated in FIG. 11.

Another modified form of corner detail is illustrated in FIGS. 11 and 11*a* and once again illustrates a stile 36' with a dado cut forming a groove 37 to receive a tongue 46 at the end of a side panel 22. In each of FIGS. 10 and 11, the top rails 32 and 34 are non-inverted or square to the ends of the side panels 48 as illustrated in FIGS. 6 and 7. Also, FIGS. 11 and 11*a* illustrate a stile with a wider sidewall 38' than sidewall 44 in FIG. 10.

FIG. 12 illustrates another corner detail commonly referred to as a rabbet/rabbet. The stile 36' corresponds to that of FIGS. 10 and 10*a* with a corner notched end 42 and outer sidewall 44. However, the side panel 22 has a notched end 50 symmetrically opposite to the notched end 42 of the stile 36 shown in FIG. 10. In addition, the outer sidewall 44 of the stile 36' in FIG. 12 is wider than the sidewall 38 of FIG. 10 and also protrudes beyond the outer surface of the side panel 22.

Figure 14:
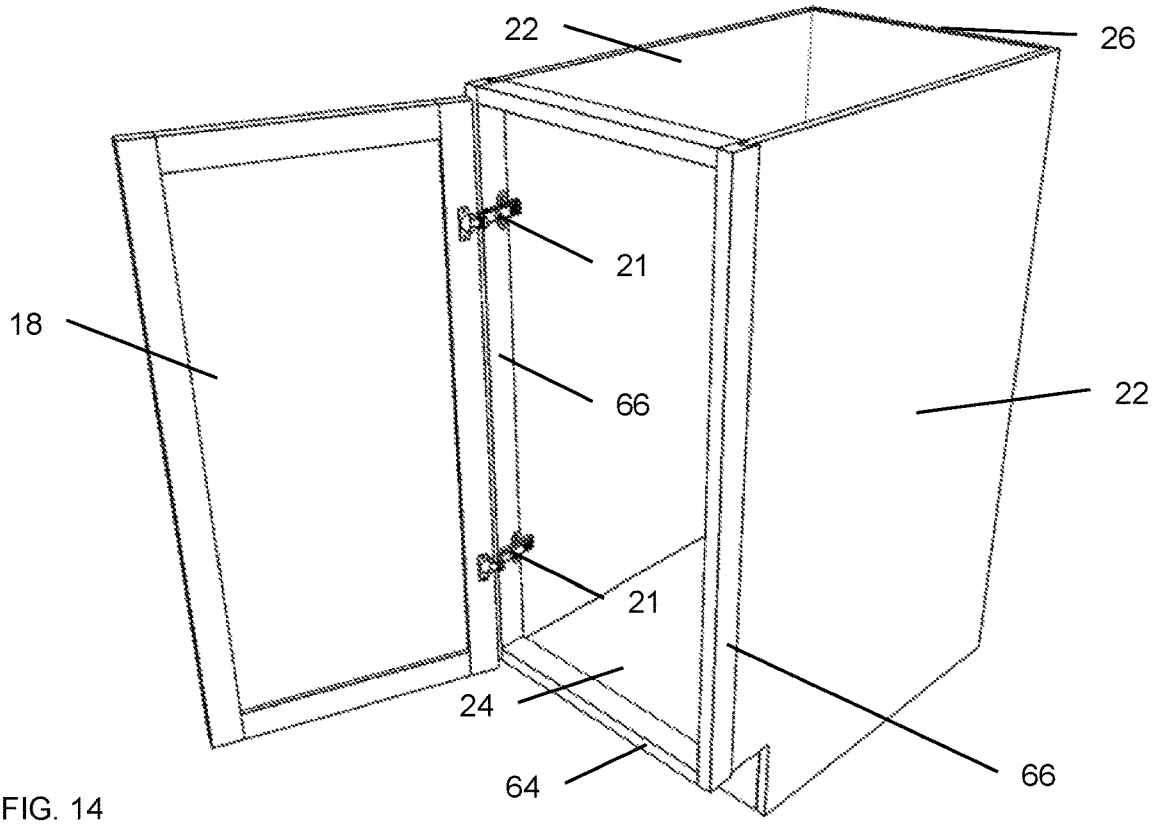
FIG. 14 is a front perspective view of one embodiment of a full access framed cabinet box having inverted stiles and rails.
Figure 15:
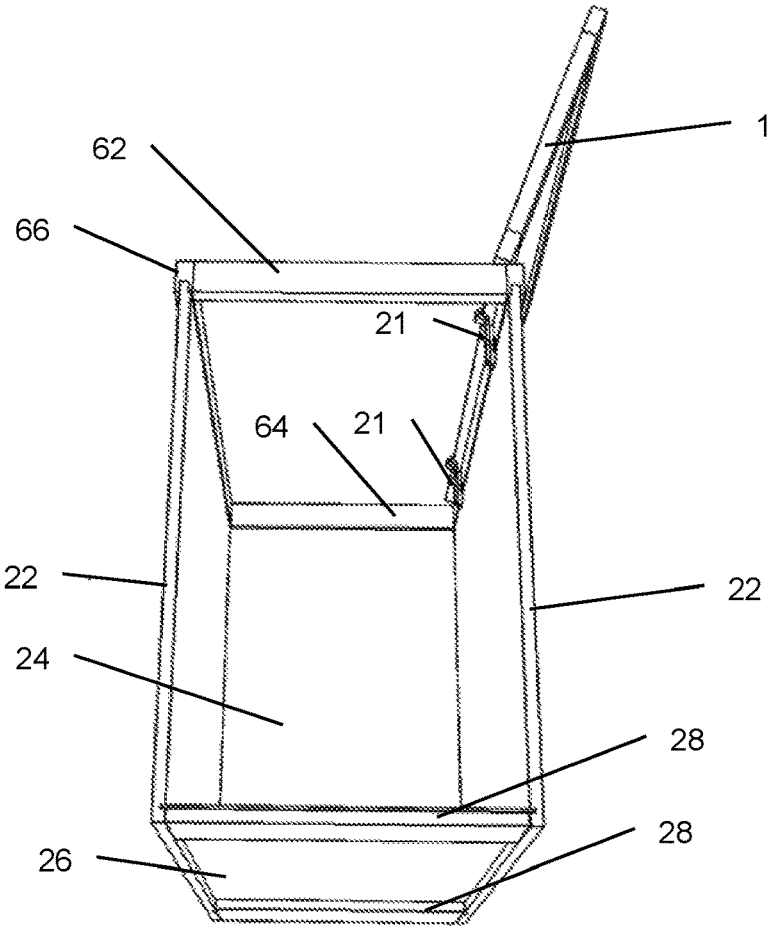
FIG. 15 is a rear perspective view of the interior of an alternative embodiment of a full access framed cabinet box.
Figure 16:
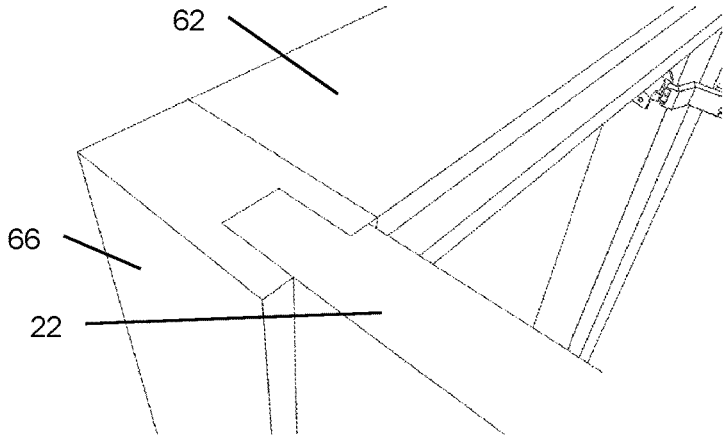
FIG. 16 is a fragmentary perspective view of a modified form of front corner detail on a full access framed cabinet box of the type illustrated in FIGS. 14 and 15.
Figure 16A:
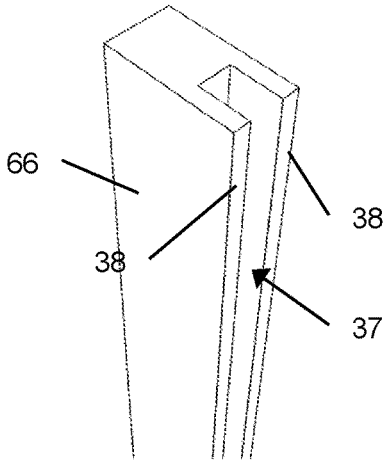
FIG. 16A is a fragmentary perspective view of the stile shown in FIG. 16.
Figure 17:
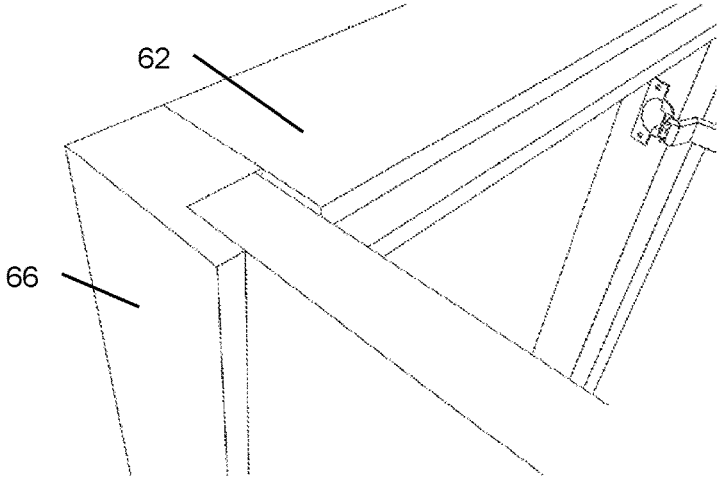
FIG. 17 is a fragmentary perspective view of a modified form of front corner detail in a full access framed cabinet box of the type illustrated in FIGS. 14 and 15.
Figure 17A:
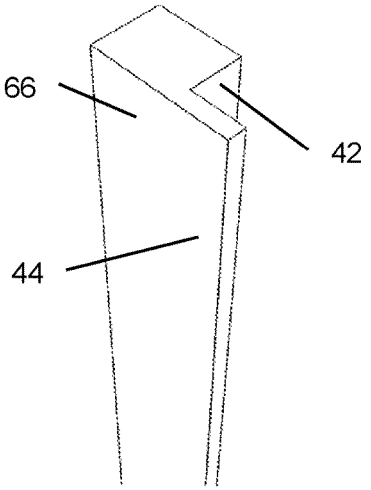
FIG. 17A is a fragmentary perspective view of the stile shown in FIG. 17.
Figure 18:
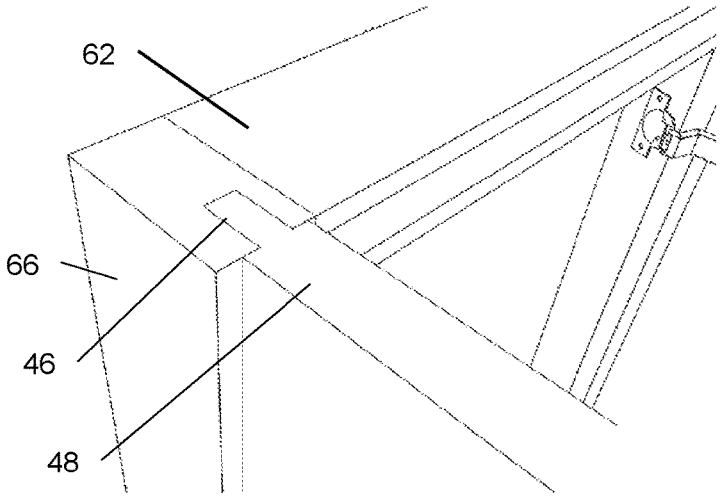
FIG. 18 is a fragmentary perspective view of a modified form of front corner detail in a full access framed cabinet box of the type illustrated in FIGS. 14 and 15.
Figure 18A:
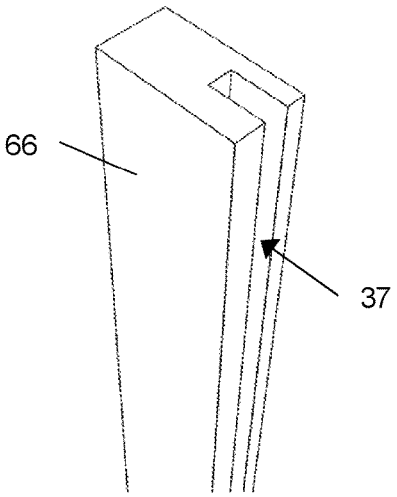
FIG. 18A is a fragmentary perspective view of the stile shown in FIG. 18.
Figure 19:
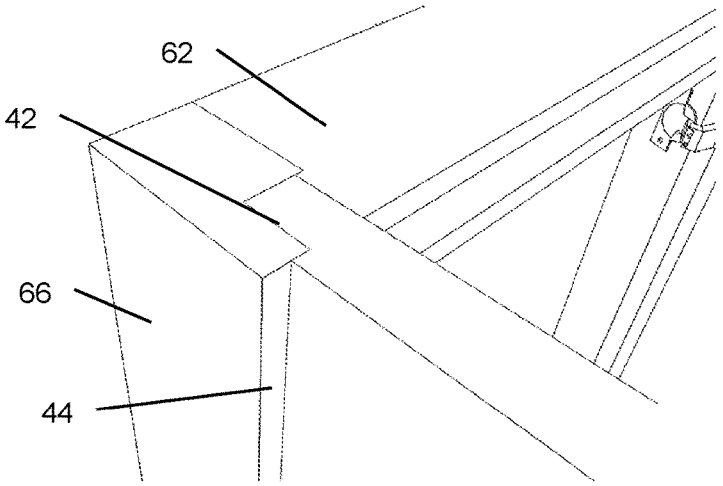
FIG. 19 is a fragmentary perspective view of a modified form of front corner detail in a full access framed cabinet box of the type illustrated in FIGS. 14 and 15.
Figure 19A:
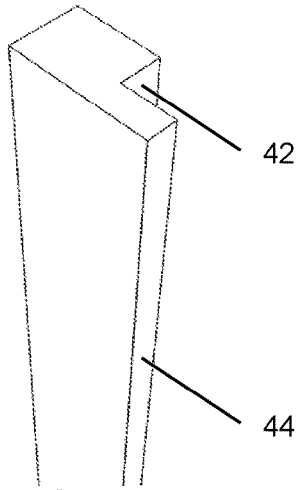
FIG. 19A is a fragmentary perspective view of the stile shown in FIG. 19.
Figure 20:
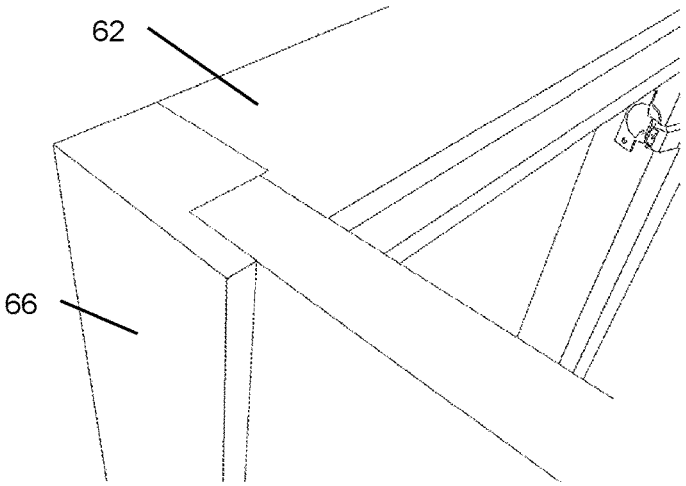
FIG. 20 is a fragmentary perspective view of a modified form of front corner detail in a full access framed cabinet box of the type illustrated in FIGS. 14 and 15.
Figure 20A:
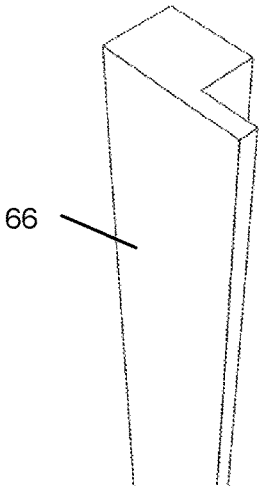
FIG. 20A is a fragmentary perspective view of the stile shown in FIG. 20.
Figure 21:
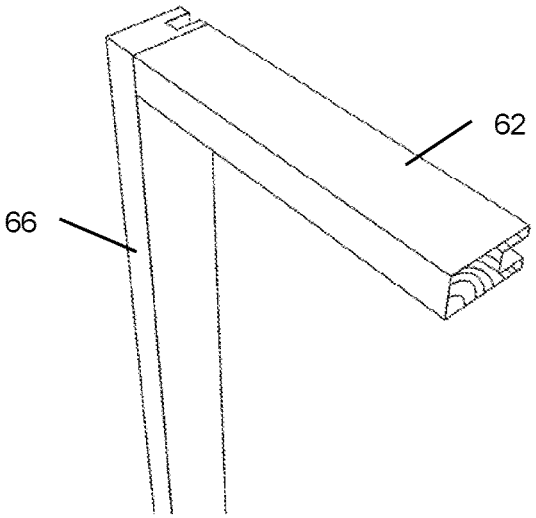
FIG. 21 is a fragmentary perspective view of a fully inverted face frame rail and adjoining stile for a full access framed cabinet box.
Figure 23:
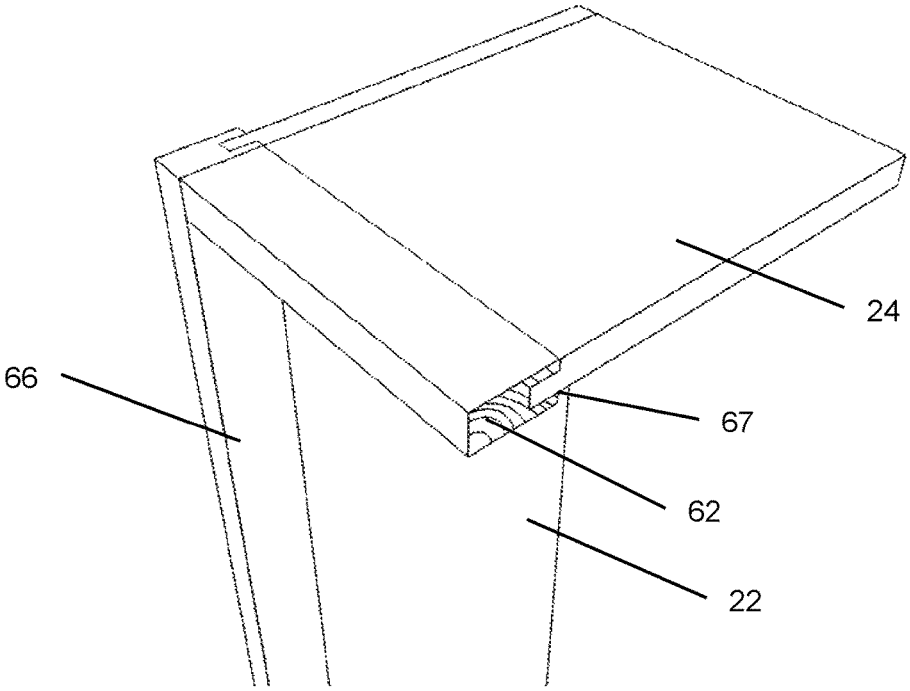
FIG. 23 is a fragmentary perspective view of the full access frame components of FIG. 22 in an assembled configuration.
Figure 22:
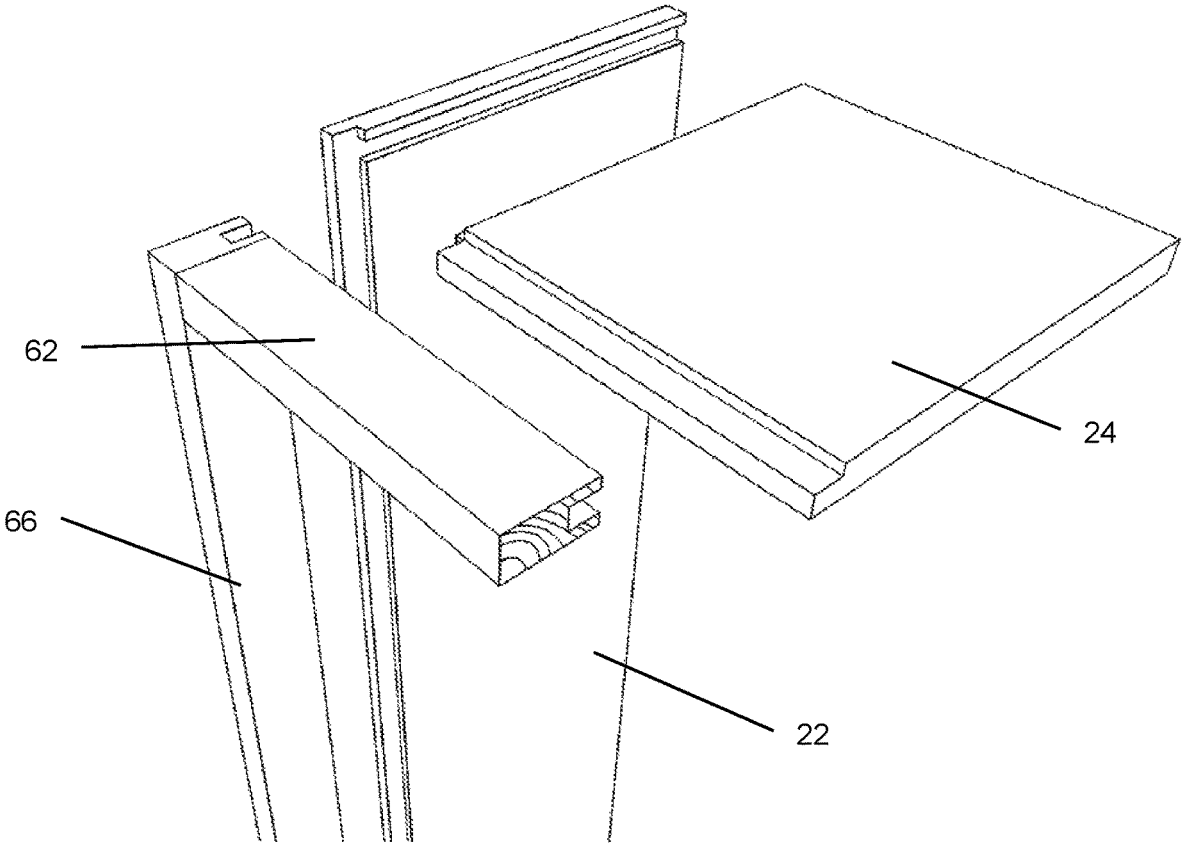
FIG. 22 is a fragmentary, exploded perspective view of an inverted face frame top rail and stile in combination with a top panel and side panel.
Figure 24:
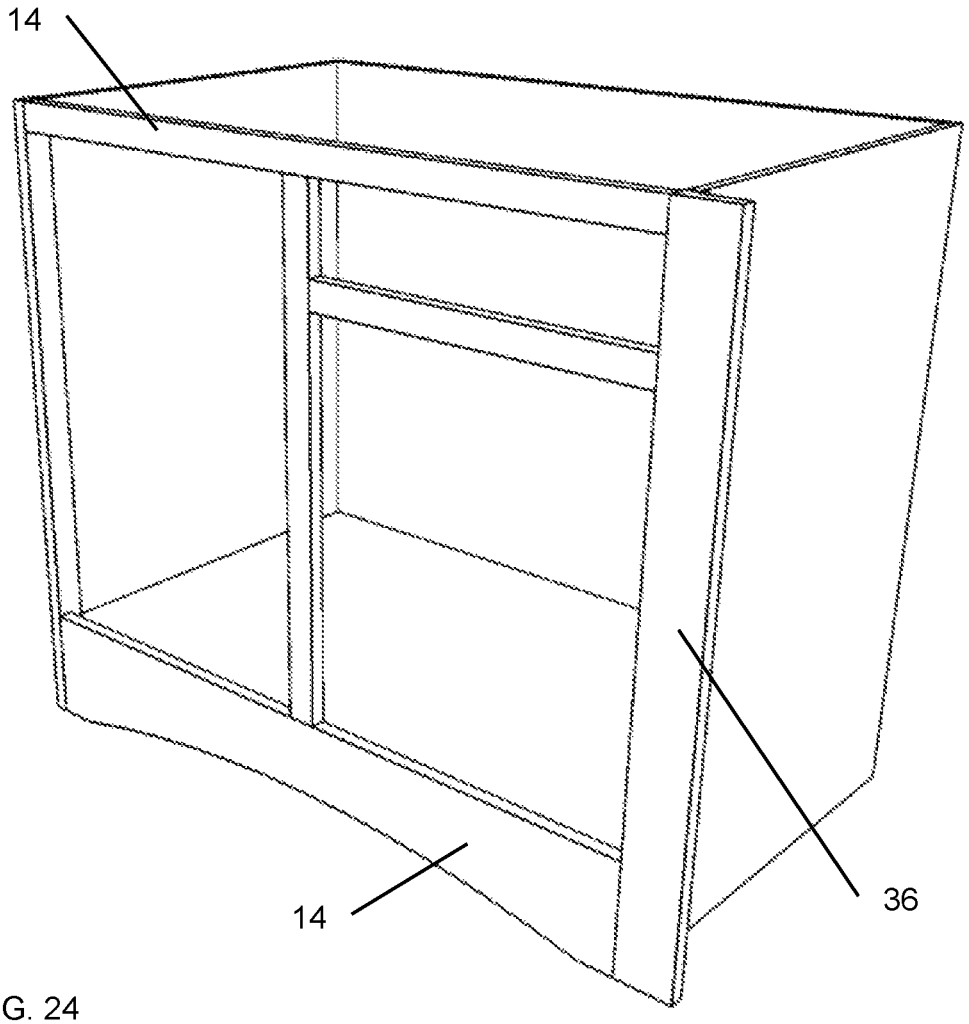
FIG. 24 is a perspective view of a semi-full access cabinet box having an extended width and made according to embodiments of the present invention, showing an integral single piece top rail, bottom rail and laterally extending side stile.
Figure 24A:
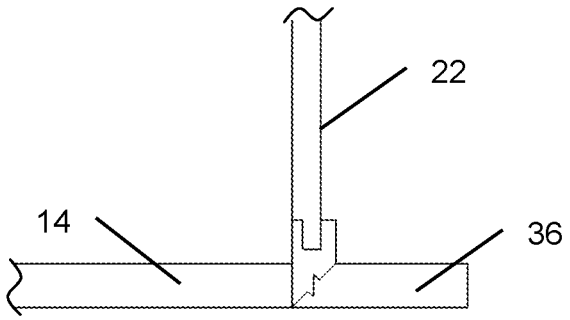
FIG. 24A is an expanded top view of the interconnection of the top rail, stile and side panel of FIG. 24, further showing a laterally extending stile joined to side panel with a deep dado lock miter joint of the type shown in FIG. 9H.
Figure 25:
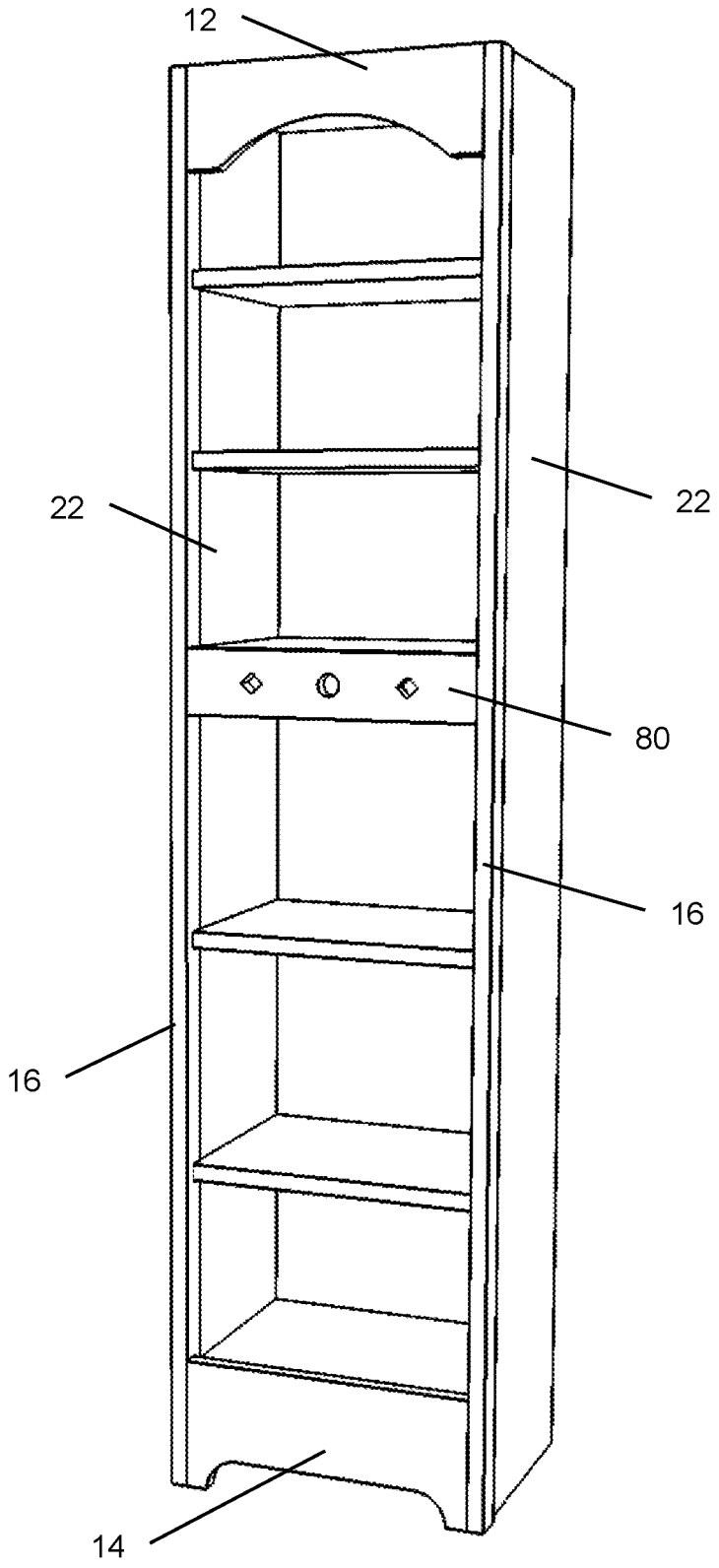
FIG. 25 is a perspective view of a semi-full access cabinet box, in the form of a bookcase, made according to the embodiments of the present invention, further showing custom aesthetics.

In the second embodiment, shown in FIGS. 14 and 15, a full access cabinet is illustrated. Again, like elements to those illustrated in FIGS. 2 and 3 are correspondingly enumerated. The box panel assembly 10 comprises side panels 22, bottom panel 24, rear panel 26 and front door 18. In FIG. 15, rear nailers 28 are behind rear panel 26. In the full access framed cabinet, the face frame may be fully assembled before connecting with the cabinet panels. The face frame of a semi-full access cabinet box may also be pre-assembled before connection to the cabinet box. A fully assembled full access face frame is shown in FIG. 27. A fully assembled semi-full access face frame is shown in FIG. 26. For example, compare FIG. 22, which shows an assembled partial frame together with unassembled top and side panels, to FIG. 23 which shows the same components in an assembled state. As part of the assembly process, the face frame members are connected, filled, sanded and finished as one unit which thereby fills any seams or voids between attaching members and provides a uniform finish. This gives a much higher end look of true furniture and quality to the face of the cabinet. In addition this allows the use of integral, single piece valances and decorative rail elements 14 and laterally extending side stiles 36, as illustrated in FIGS. 24 and 24A. As should be appreciated, these elements may comprise decorative shapes and details which are attractive, particularly when used on open face cabinets without doors covering the face. For example, FIG. 25 shows a cabinet box in the form of a bookcase. Both the bottom rail 14 and top rail 12 are decorative with custom detailing. In addition, a decorative middle rail 80 is also included. It should be appreciated that this can be accomplished in either a semi-full or full access frame.

As shown in FIGS. 14 and 15, the face frame, which is mounted on the front end of the box panel assembly 10, is made up of top and bottom inverted rails 62 and 64 extending between inverted stiles 66; and a door panel 18 is mounted in hinged relation to the face frame by means of hinges 21 in the same manner as described in the first embodiment, for example, as shown in FIG. 28A. Accordingly, the entire face frame made up of the rails 62 and 64 in combination with the stiles 66 is inverted with respect to the panels 22 and 24 so as to increase the effective size of the front opening both vertically and laterally.

The corner detail views of FIGS. 16 to 20 correspond to those of FIGS. 8 to 12, respectively, with respect to mounting of the inverted stiles with respect to the side panels and are correspondingly enumerated. The same is true of the individual stiles illustrated in FIGS. 16A to 20A which correspond to those of FIGS. 8A to 13A respectively. However, the rails 62 illustrated in FIGS. 16 to 20 are shown in the inverted position.

FIG. 29 illustrates multiple cabinet boxes made according to embodiments of the present invention, and further mounted to a wall. Lower cabinet boxes 82 are assembled with individual full access face frames. Upper cabinet boxes 84 are assembled with a single full access face frame having a single piece, seamless top rail 12, bottom rail 14 and center stile 16. The frames may be fully assembled, sanded and finished prior to joining with the cabinet box to provide a uniform aesthetic finish. Alternatively, the frame members may be separately finished, but at the same time to provide a uniform finish, and then jointed to the cabinet box as part of the installation process.

The concepts of the semi-full access inverted frame and/or a full access inverted frame may also be incorporated into cabinet boxes with inset doors. FIGS. 30A-33A illustrate a semi-full access frame and cabinet box assembly with an inset door. For illustrative purposes, FIGS. 30B-33B show a traditional framed cabinet box with an inset door. A number of differences are present. As best shown in FIGS. 32A and 32B, the traditional framed cabinet of FIG. 32B has a smaller opening. The stiles 16 shown in FIG. 32B extend laterally into the opening of the cabinet box. This is not the case with the frame and cabinet box of FIG. 32A. In FIG.

32A, the inner surface 16" of the stiles 16 are flush or substantially flush with the inner surface of the side panels 22. As a result, and as seen in comparing FIG. 31A to FIG. 31B, the inset door 18 in FIG. 31B is smaller than the door shown in FIG. 31A. A difference in hardware also is evident.

Regarding hinges, the hinges 21 used in the traditional cabinet of FIG. 32B mount to the back surface 16''' of the stile, while the hinge 21 used in association with the semi-full access inverted frame cabinet of FIG. 32A mount to the stile itself, similar to as shown in FIG. 28A. In addition, because the inner surface 16" of the stile in the traditional framed cabinet is not flush or substantially flush with the inner surface of the side panel 22, a drawer guide 70 must be connected to the rear panel 26 as shown in FIG. 28E.

There are also aesthetic differences. FIGS. 33A and 33B illustrate a pair of abutting cabinet boxes. In FIG. 33A, because the stiles 16 are inverted a more symmetrical and aesthetically pleasing cabinet face is provided. Assuming a typical face frame having cross-sectional dimensions of 1.5 inches by 0.75 inches, because the stiles 16 are inverted in FIG. 33A, the width of each stile across the face of the cabinet is 0.75 inches. Accordingly, the abutting stiles 16 have a combined width of 1.5 inches. This is the same width for the rails 12 and 14. In contrast, as shown in FIG. 33B, because the stiles 16 are not inverted, the abutting stiles 16 have a combined width of 3.0 inches, which is twice the width as the rails 12 and 14.

Incorporating either a semi-full access inverted frame or a full access inverted frame into the cabinet construction also allows the cabinet to utilize current efficiency manufacturing methods in including face "frame down assembly" and "dado joining" of box components vs labor intensive doweling and case clamping.

From the foregoing, it will be apparent that the framed cabinetry of the type described avoids a number of weaknesses of traditional framed cabinetry as well as frameless cabinetry while at the same time retaining a number of the favorable characteristics of both types of cabinetry. Specifically, with respect to framed cabinetry, it offers the same superior strength compared to frameless, lends itself well to applied end skins and interior skins to repair cabinetry when needed, allows for extended stiles and fillers to be applied to the face frame members and composed of the same material as the box face, allows for construction and manufacturing methods that are very efficient and cost effective, flexibility of installation, for example, utilizing a more open top for ease of access to interior, allows for flexibility of movement from cabinet to cabinet or cabinet to wall if needed, and is able to utilize solid wood secured together with greater strength and securing than non-solid components.

It is therefore to be understood that while different embodiments are herein set forth and described, the above and other modifications and changes may be made in the construction and arrangement of elements as well as intended use of the apparatus without departing from the spirit and scope thereof. For example, the corner details shown are given more for the purpose illustration but not limitation. It is also understood that while not a preferred method one could also potentially create a frame a similar nature using square stiles instead on deeper stiles. This however would be very week and nature and would likely not be accepted.

Although the preferred embodiments of present invention have been described herein, the above description is merely illustrative. The preferred embodiments disclosed will not limited the scope of the present invention. Further modification of the invention herein disclosed will occur to those skilled in the respective arts and all such modifications are deemed to be within the scope of the invention as defined by the appended claims.

The present invention, in various embodiments, includes components, methods, processes, systems and/or apparatus substantially as depicted and described herein, including various embodiments, sub combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. The features of the embodiments of the invention may be combined in alternate embodiments other than those discussed above.

Moreover, though the description of the invention has included description of one or more embodiments and certain variations and modifications, other variations, combinations, and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A cabinet, comprising:

a panel assembly configured to affix to a wall, the panel assembly comprising:

a first side panel, a second side panel, and a bottom panel, each panel having an inner surface and an outer surface, the inner surface of each panel faces an interior space of the panel assembly and the outer surface of each panel forms an exterior surface of the panel assembly, the panel assembly having a front end with an opening having a lateral width and a vertical height, and wherein there is an absence of any frame member extending along substantially the full depth of the panel assembly; and a face frame connected to the front end of the panel assembly, the face frame including:

a first vertical frame member interconnected to the first side panel and having an inner surface and an outer surface, the inner surface being substantially flush to the inner surface of the first side panel and the outer surface extending laterally outward of the outer surface of the first side panel, the first vertical frame member having a longer dimension extending parallel to the first side panel and a shorter dimension extending perpendicular to the first side panel;

a second vertical frame member interconnected to the second side panel and having an inner surface and an outer surface, the inner surface being substantially flush to the inner surface of the second side panel and the outer surface extending laterally outward of the outer surface of the second side panel, the second vertical frame member having a longer dimension extending parallel to the second side panel and a shorter dimension extending perpendicular to the second side panel;

a top rail extending horizontally between the first vertical frame member and the second vertical frame member, the top rail having a depth that extends approximately perpendicular to the opening of the cabinet box and a width that extends approximately parallel to the opening of the cabinet box, wherein the width of the top rail is greater than the depth of the top rail, and the top rail having a first end directly connected to the first vertical frame member and a second end directly connected to the second vertical frame member; and a bottom rail extending horizontally between the first vertical frame member and the second vertical frame member, the bottom rail having a depth that extends approximately perpendicular to the opening of the cabinet box and a width that extends approximately parallel to the opening of the cabinet box, wherein the width of the bottom rail is greater than the depth of the bottom rail, and the bottom rail having a first end directly connected to the first vertical frame member and a second end directly connected to the second vertical frame member;

wherein the orientation of the first vertical frame member and the second vertical frame member permit substantially full access into the interior space of the panel assembly across the lateral width of the opening, and wherein the face frame provides structural support to the panel assembly.

2. The cabinet of claim 1, further comprising a euro-hinge flush mounted on the inner surface of the first vertical frame member and first side panel, with at least two screws connecting the hinge to the first vertical frame member and at least one screw connecting the hinge to the side panel.

3. The cabinet of claim 1, further comprising a drawer guide flush mounted on the inner surface of the first vertical frame member and the inner surface of the first side panel and wherein at least one end of the drawer guide is attached to the first vertical frame member by at least two screws and the opposite end of the drawer guide is attached to the side panel by a screw.

4. The cabinet of claim 1, wherein the depth of the first vertical frame member and of the second vertical frame member enables full mounting of a first drawer guide to the first vertical frame member and not to a side panel alone, and a second drawer guide to the second vertical frame member and not to a side panel alone.

5. A cabinet comprising:

a cabinet box configured to affix to a wall comprising:

a panel assembly including a first side panel, a second side panel and a bottom panel, each panel having an interior surface and an exterior surface, the interior surface of each panel faces an interior space of the cabinet box and the exterior surface of each panel faces the exterior of the cabinet box, the panel assembly having a front end with an opening that provides access to the interior space, the opening having a height and a width and defining an opening plane;

a face frame assembly, comprising:

a first vertical frame member having a depth that extends approximately perpendicular to the opening plane of the cabinet box and a width that extends approximately parallel to the opening plane of the cabinet box, wherein the depth of the first vertical frame member is greater than the width of the first vertical frame member;

a second vertical frame member having a depth that extends approximately perpendicular to the opening plane of the cabinet box and a width that extends approximately parallel to the opening plane of the cabinet box, wherein the depth of the second vertical frame member is greater than the width of the second vertical frame member, and wherein the second vertical frame member is spaced apart from the first vertical frame member by approximately the width of the opening of the cabinet box;

a first horizontal frame member extending between the first vertical frame member and the second vertical frame member, the first horizontal frame member having a depth that extends approximately perpendicular to the opening plane of the cabinet box and a width that extends approximately parallel to the opening plane of the cabinet box, wherein the width of the first horizontal frame member is greater than the depth of the first horizontal frame member, and the first horizontal frame member having a first end directly connected to the first vertical frame member by a deep dado forty-five degree miter joint or a deep dado lock miter joint and a second end directly connected to the second vertical frame member; and a second horizontal frame member extending between the first vertical frame member and the second vertical frame member, the second horizontal frame member having a depth that extends approximately perpendicular to the opening plane of the cabinet box and a width that extends approximately parallel to the opening plane of the cabinet box, wherein the width of the second horizontal frame member is greater than the depth of the second horizontal frame member, and the second horizontal frame member having a first end directly connected to the first vertical frame member and a second end directly connected to the second vertical frame member;

wherein the face frame is connected to the front end of the panel assembly to provide structural support to the cabinet box;

at least one door mounted to the face frame assembly; and wherein, when the at least one door is open, substantially full access into the interior space of the cabinet box across the width of the opening is provided between the first vertical frame member and the second vertical frame member, the first horizontal frame member and the second horizontal frame member do not permit full access across the height of the opening, and when the door is closed, the at least one door is inset relative to the face frame.

6. The cabinet of claim 5, wherein the depth of the first vertical frame member and of the second vertical frame member enables full mounting of a first euro style hinge to the first vertical frame member and not to a side panel alone, and a second euro style hinge to the second vertical frame member and not to a side panel alone.

7. The cabinet of claim 5, wherein the depth of the first vertical frame member and of the second vertical frame member enables full mounting of a first drawer guide to the first vertical frame member and not to a side panel alone, and a second drawer guide to the second vertical frame member and not to a side panel alone.

8. The cabinet of claim 5, further comprising a euro style hinge flush mounted on an inner surface of the first vertical frame member and first side panel, with at least two screws connecting the hinge to the first vertical frame member and at least one screw connecting the hinge to the side panel.

9. The cabinet of claim 5, further comprising a drawer guide flush mounted on an inner surface of the first vertical frame member and the inner surface of the first side panel and wherein at least one end of the drawer guide is attached to the first vertical frame member by at least two screws and the opposite end of the drawer guide is attached to the side panel by a screw.

10. A cabinet, comprising:

a panel assembly comprising:

a first side panel, a second side panel, and a bottom panel, each panel having an inner surface and an outer surface, the inner surface of each panel faces an interior space of the panel assembly and the outer surface of each panel forms an exterior surface of the panel assembly, the panel assembly having a front end with an opening having a lateral width and a vertical height, and wherein there is an absence of any frame member extending along substantially the full depth of the panel assembly and an absence of a top panel substantially enclosing the top of the panel assembly; and a face frame connected to the front end of the panel assembly, the face frame having:

a first vertical frame member interconnected to the first side panel and having an inner surface and an outer surface, the inner surface being substantially flush to the inner surface of the first side panel and the outer surface extending laterally outward of the outer surface of the first side panel, the first vertical frame member having a longer dimension extending parallel to the first side panel and a shorter dimension extending perpendicular to the first side panel;

a second vertical frame member interconnected to the second side panel and having an inner surface and an outer surface, the inner surface being substantially flush to the inner surface of the second side panel and the outer surface extending laterally outward of the outer surface of the second side panel, the second vertical frame member having a longer dimension extending parallel to the second side panel and a shorter dimension extending perpendicular to the second side panel;

a top rail extending horizontally between the first vertical frame member and the second vertical frame member, the top rail having a depth that extends approximately perpendicular to the opening of the cabinet box and a width that extends approximately parallel to the opening of the cabinet box, wherein the width of the top rail is greater than the depth of the top rail, and the top rail having a first end directly connected to the first vertical frame member and a second end directly connected to the second vertical frame member; and a bottom rail extending horizontally between the first vertical frame member and the second vertical frame member, the bottom rail having a depth that extends approximately perpendicular to the opening of the cabinet box and a width that extends approximately parallel to the opening of the cabinet box, wherein the width of the bottom rail is greater than the depth of the bottom rail, and the bottom rail having a first end directly connected to the first vertical frame member and a second end directly connected to the second vertical frame member;

wherein the orientation of the first vertical frame member and the second vertical frame member permit substantially full access into the interior space of the panel assembly across the lateral width of the opening, and wherein the face frame provides structural support to the panel assembly.

11. The cabinet of claim 10, wherein the cabinet is affixed to a wall at a position spaced above a floor.

12. The cabinet of claim 10, further comprising at least one shelf positioned within the interior space.

* * * * *